US010627743B2

(12) United States Patent
Nieda

(10) Patent No.: US 10,627,743 B2
(45) Date of Patent: Apr. 21, 2020

(54) POWDER CONTAINER, PROCESS CARTRIDGE, AND IMAGE FORMING APPARATUS

(71) Applicant: Hiroaki Nieda, Kanagawa (JP)

(72) Inventor: Hiroaki Nieda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/390,263

(22) Filed: Apr. 22, 2019

(65) Prior Publication Data

US 2019/0361374 A1 Nov. 28, 2019

(30) Foreign Application Priority Data

May 25, 2018 (JP) ..... 2018-100460

(51) Int. Cl.
*G03G 15/08* (2006.01)

(52) U.S. Cl.
CPC ..... *G03G 15/0889* (2013.01)

(58) Field of Classification Search
CPC ..... G03G 15/0889
See application file for complete search history.

(56) References Cited

U.S. PATENT DOCUMENTS 6,246,854 B1 * 6/2001 Kurosawa ..... G03G 15/0894 399/263
6,526,245 B1 * 2/2003 Yamashita ..... G03G 15/0822 399/254
7,532,844 B2 * 5/2009 Tanaka ..... G03G 21/1814 399/111
7,796,925 B2 * 9/2010 Oda ..... G03G 15/0898 399/120
8,121,524 B2 * 2/2012 Sakoh ..... G03G 15/0877 399/120
8,260,178 B2 * 9/2012 Kuroyama ..... G03G 15/0868 399/111
2006/0222414 A1 * 10/2006 Yamamura ..... G03G 15/0822 399/263
2007/0196135 A1 * 8/2007 Fukuta ..... G03G 15/0874 399/254
2007/0264051 A1 * 11/2007 Tanaka ..... G03G 15/0875 399/254
2008/0298846 A1 * 12/2008 Ohgoshi ..... G03G 15/0872 399/263
2009/0162101 A1 * 6/2009 Yoshida ..... G03G 15/0877 399/254

(Continued)

FOREIGN PATENT DOCUMENTS

JP 2006-276615 10/2006
JP 2007-183519 7/2007

(Continued)

*Primary Examiner* — G. M. A Hyder
(74) *Attorney, Agent, or Firm* — Harness, Dickey and Pierce, P.L.C.

(57) ABSTRACT

A powder container includes an inner wall, a rotation axis, and a flap to rotate about the rotation axis. The flap includes a comb-teeth tip portion to contact and slide along an inner wall surface of the powder container. The comb-teeth tip portion has teeth in which a distance from a root between adjacent teeth to the rotation axis when the comb-teeth tip portion does not contact the inner wall surface is longer than a shortest distance from the inner wall surface to the rotation axis.

14 Claims, 12 Drawing Sheets

(56) References Cited

U.S. PATENT DOCUMENTS

| | | | | |
|---|---|---|---|---|
| 2009/0208253 | A1* | 8/2009 | Ohgoshi | G03G 15/0872 399/262 |
| 2017/0168446 | A1 | 6/2017 | Nieda | |
| 2017/0199490 | A1 | 7/2017 | Nieda | |
| 2018/0112762 | A1 | 4/2018 | Nieda | |
| 2018/0224779 | A1 | 8/2018 | Tomita et al. | |
| 2018/0329339 | A1 | 11/2018 | Nieda | |
| 2019/0018353 | A1 | 1/2019 | Tomita et al. | |
| 2019/0243284 | A1* | 8/2019 | Nieda | G03G 15/0889 |

FOREIGN PATENT DOCUMENTS

| | | |
|---|---|---|
| JP | 2010-032754 | 2/2010 |
| JP | 2010-096991 | 4/2010 |
| JP | 2011-028304 | 2/2011 |

* cited by examiner

POWDER CONTAINER, PROCESS CARTRIDGE, AND IMAGE FORMING APPARATUS

CROSS-REFERENCE TO RELATED APPLICATIONS

This patent application is based on and claims priority pursuant to 35 U.S.C. § 119 to Japanese Patent Application No. 2018-100460, filed on May 25, 2018 in the Japanese Patent Office, the entire disclosure of which is hereby incorporated by reference herein.

BACKGROUND

Technical Field

This disclosure generally relates to a powder container to store powder therein, a process cartridge including the powder container, and an image forming apparatus, such as a copier, a printer, a facsimile machine, or a multifunction peripheral (MFP) having one or more such functions, that is adapted to incorporate the process cartridge.

Background Art

In an image forming apparatus such as a copier, a printer and a facsimile, a powder container is known in which a flexible member such as a plastic film rotates about a rotational shaft and stirs powder in the powder container.

SUMMARY

This specification describes an improved powder container that includes an inner wall, a rotation axis, and a flap to rotate about the rotation axis. The flap includes a comb-teeth tip portion to contact and slide along an inner wall surface of the powder container. The comb-teeth tip portion has teeth in which a distance from a root between adjacent teeth to the rotation axis when the comb-teeth tip portion does not contact the inner wall surface is longer than a shortest distance from the inner wall surface to the rotation axis.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
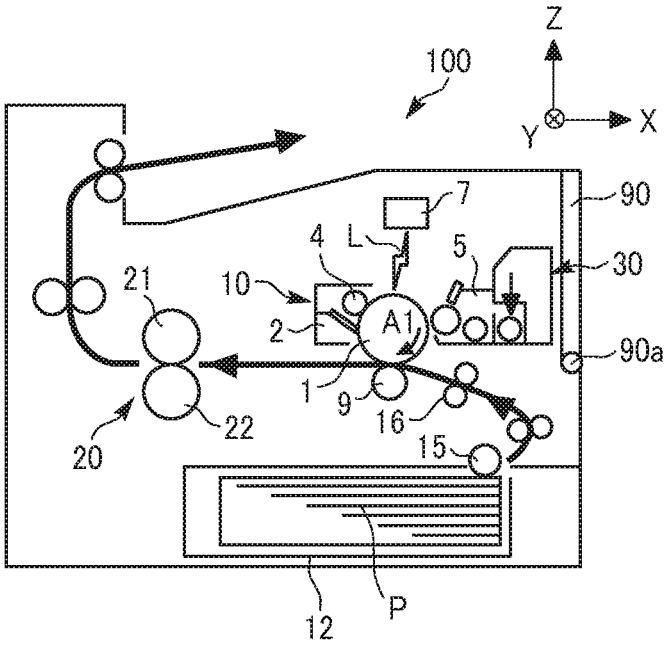
FIG. 1 is a diagram illustrating an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

Now, a description is given of a configuration and operation of an image forming apparatus 100 with reference to FIG. 1. FIG. 1 is a diagram illustrating an overall configuration of an image forming apparatus according to an embodiment of the present disclosure.

In FIG. 1, the image forming apparatus 100 that is a printer in the present embodiment includes a photoconductor drum 1 on which a toner image is formed, and an exposure device 7 serving as a writing device. The exposure device 7 irradiates the photoconductor drum 1 with exposure light L based on image data input from an input device such as a personal computer.

The image forming apparatus 100 further includes a transfer roller 9 to transfer the toner image borne on a surface of the photoconductor drum 1 onto a sheet P conveyed to a transfer nip that is a transfer position; a process cartridge 10 in which the photoconductor drum 1, a charging roller 4, a developing device 5, a cleaner 2, and a waste toner conveyor 6 (see FIG. 2) are united; and a sheet feeder 12 such as a sheet tray to accommodate the sheets P such as paper sheets.

The image forming apparatus 100 yet further includes a registration roller pair 16 serving as a timing roller pair to feed the sheet P toward the transfer nip where the photoconductor drum 1 contacts the transfer roller 9, a fixing device 20 to fix an unfixed image on the sheet P, and a toner container 30 serving as a powder container. The fixing device 20 includes a fixing roller 21 and a pressure roller 22.

Around the photoconductor drum 1, the charging roller 4, the developing device 5, the cleaner 2, and the waste toner conveyor 6 are disposed. The above components (i.e., the photoconductor drum 1, the charging roller 4, the developing device 5, the cleaner 2, and the waste toner conveyor 6) are united as the process cartridge 10. The removable process cartridge 10 is installed in the body of the image forming apparatus 100. The process cartridge 10 is replaced with a new process cartridge in a predetermined replacement cycle.

The toner container 30 serving as the powder container is removably and replaceably attached on an upper portion of the developing device 5 of the process cartridge 10 that is removably installed in the body of the image forming apparatus 100. A toner storage 31 in the toner container 30 stores toner (fresh toner) as powder. The toner is appropriately supplied from the toner container 30 to the inside of the developing device 5. When the toner container 30 runs out of toner (or toner contained in the developing device 5 is depleted), the toner container 30 is replaced with a new toner container. The toner container 30 according to the present embodiment further includes a waste toner collection portion 32 serving as a powder collection portion in addition to the toner storage 31 serving as a powder storage. The waste toner collection portion 32 is described in detail later.

Figure 2:
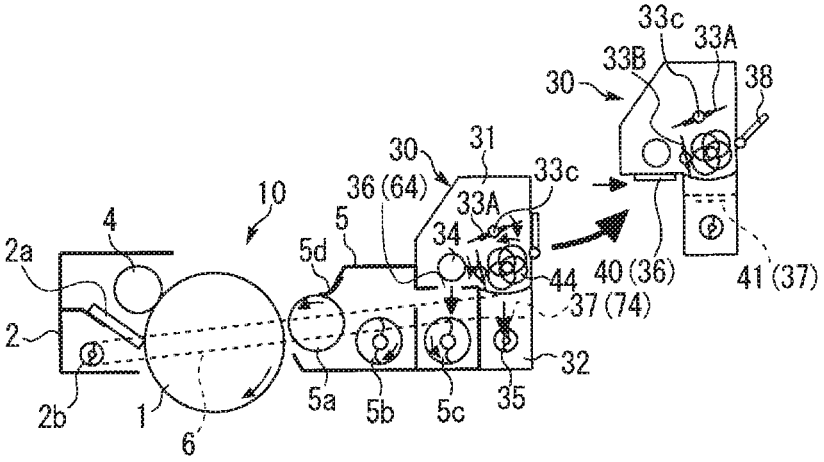
FIG. 2 is a schematic diagram illustrating a process cartridge and a toner container.

Now, a description is given of regular image forming operations performed by the image forming apparatus 100 with reference to FIGS. 1 and 2. FIG. 2 is a schematic diagram illustrating a process cartridge and a toner container.

With reference to FIG. 1, as image data is transmitted from the input device, such as a personal computer, to the exposure device 7 in the image forming apparatus 100, the exposure device 7 irradiates the surface of the photoconductor drum 1 with the exposure light (a laser beam) L based on the image data.

Meanwhile, the photoconductor drum 1 rotates in a direction indicated by arrow A1 in FIG. 1, that is, a clockwise direction. Initially, the charging roller 4 uniformly charges the surface of the photoconductor drum 1 opposite the charging roller 4, which is called a charging process. As a result, a charging potential is formed on the surface of the photoconductor drum 1. In the present embodiment, the charging potential on the photoconductor drum 1 is approximately −900V. The charged surface of the photoconductor drum 1 thereafter reaches a position to receive the exposure light L. An electric potential at the position that receives the exposure light L changes a latent image potential (about 0 to −100 V), and an electrostatic latent image is formed on the surface of the photoconductor drum 1, which is called an exposure process.

The surface of the photoconductor drum 1 bearing the electrostatic latent image thereon then reaches a position opposite the developing device 5. The developing device 5 supplies toner onto the photoconductor drum 1, and the latent image formed on the photoconductor drum 1 is thereby developed into a toner image, which is called a developing process.

As illustrated in FIG. 2, the developing device 5 includes the developing roller 5*a*, two development conveying screws 5*b* and 5*c*, and a doctor blade 5*d*. The developing device 5 contains toner, that is, one-component developer. Toner is supplied from a discharge port 36 of the toner storage 31 in the toner container 30 to the developing device 5 via an inlet port 64 of the developing device 5 according to consumption of toner in the developing device 5. The two conveying screws 5*b* and 5*c* stir and mix the supplied toner with the toner contained in the developing device 5 while circulating the toner in a longitudinal direction of the developing device 5, which is a direction perpendicular to the surface of the paper on which FIG. 2 is drawn. The developing roller 5*a* scoops up a part of the toner conveyed by the conveying screw 5*b*. The amount of toner scooped up by the developing roller 5*a* is regulated by the doctor blade 5*d* and reaches a position opposite the photoconductor drum 1 that is called a developing region. The doctor blade 5*d* rubs the toner on the developing roller 5*a* and triboelectrically charges the toner. The regulated toner adheres to the electrostatic latent image on the photoconductor drum 1 at the developing region, thereby forming the toner image on the photoconductor drum 1. A drive motor disposed in the image forming apparatus 100 rotates the developing roller 5*a* and the two conveying screws 5*b* and 5*c* in directions indicated by arrows in FIG. 2.

After the developing process, the surface of the photoconductor drum 1 bearing the toner image thereon reaches the transfer nip (the transfer position) formed between the photoconductor drum 1 and the transfer roller 9. In the transfer nip, a transfer bias having an opposite polarity to toner is applied from a power source to the transfer roller 9, and the toner image formed on the photoconductor drum 1 is thereby transferred onto the sheet P fed by the registration roller pair 16, which is called a transfer process.

The surface of the photoconductor drum 1 after the transfer process reaches a position opposite the cleaner 2. At the position opposite the cleaner 2, a cleaning blade 2*a* mechanically removes untransferred toner remaining on the surface of the photoconductor drum 1, and removed toner is collected in the cleaner 2, which is called a cleaning process.

A series of image forming processes on the photoconductor drum 1 is thus completed.

The untransferred toner collected in the cleaner 2 is conveyed by a collection screw 2*b* to one end of the cleaner 2 in a width direction that is a rotation axis direction of the collection screw 2*b*, conveyed in a diagonally upper right direction in FIG. 2 by the waste toner conveyor 6 including a waste toner coil 6*a*, and collected as waste toner from an outlet port 74 of the waste toner conveyor 6 to the inside of the waste toner collection portion 32 of the toner container 30 via a collection port 37 of the toner container 30.

In the new toner container 30, the toner storage 31 is filled with fresh toner, and the waste toner collection portion 32 is empty.

The sheet P is conveyed to the transfer nip (i.e., the transfer position) between the photoconductor drum 1 and the transfer roller 9 as follows.

First, a feed roller 15 feeds the sheet P stored at the top in the sheet feeder 12 toward a conveyance path.

The sheet P thereafter reaches a position of the registration roller pair 16. The sheet P is fed from the position of the registration roller pair 16 to the transfer nip (i.e., contact position of the transfer roller 9 with the photoconductor drum 1) in synchronization with an entry of the toner image formed on the photoconductor drum 1 into the transfer nip.

After the transfer process, the sheet P passes through the transfer nip (i.e., position of the transfer roller 9) and reaches the fixing device 20 via a conveyance path. In the fixing device 20, the sheet P is interposed between the fixing roller 21 and the pressure roller 22, and the toner image is fixed on the sheet P by heat applied from the fixing roller 21 and pressure applied from both the fixing roller 21 and the pressure roller 22. After the sheet P having the fixed toner image thereon is ejected from the fixing nip formed between the fixing roller 21 and the pressure roller 22, the sheet P is ejected from the body of the image forming apparatus 100 and stacked on an output tray.

A series of image forming processes is thus completed.

Figure 3A:
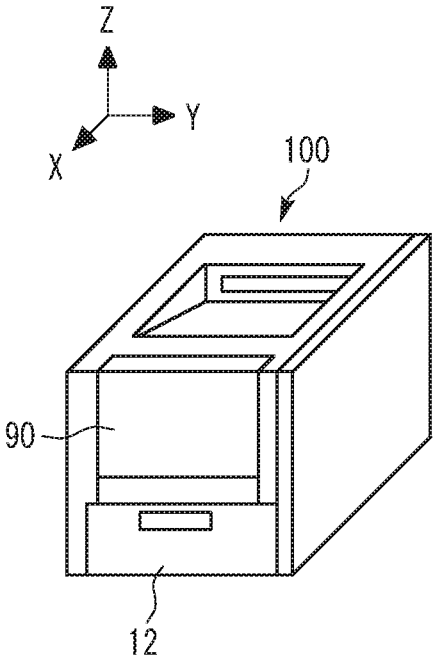
FIG. 3A is a perspective view illustrating the image forming apparatus.
Figure 3B:
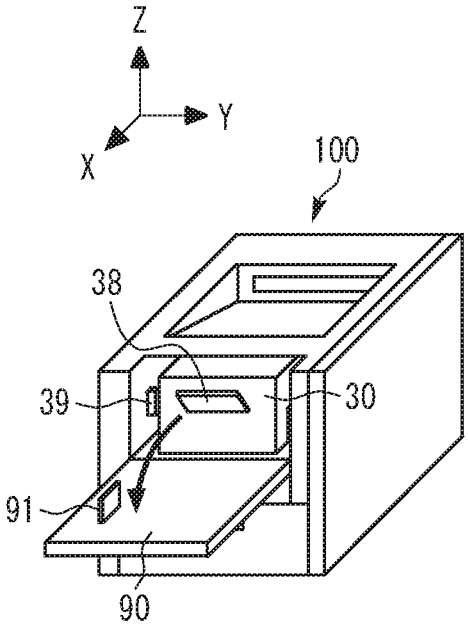
FIG. 3B is a perspective view illustrating the image forming apparatus with a cover open.

According to the present embodiment, the image forming apparatus 100 is covered with a plurality of exterior covers as illustrated in FIG. 3A. As illustrated in FIG. 3B, a part of a front exterior cover functions as a cover 90 that swings open and shut.

Specifically, the cover 90 is secured to the image forming apparatus 100 and hinged around a spindle 90*a* as a rotation axis as illustrated in FIG. 1. As the cover 90 rotates counterclockwise in FIG. 1 around the spindle 90*a*, the cover 90 closes as illustrated in FIGS. 1 and 3A. As the cover 90 rotates clockwise in FIG. 1 around the spindle 90*a*, the cover 90 opens as illustrated in FIG. 3B.

Figure 4:
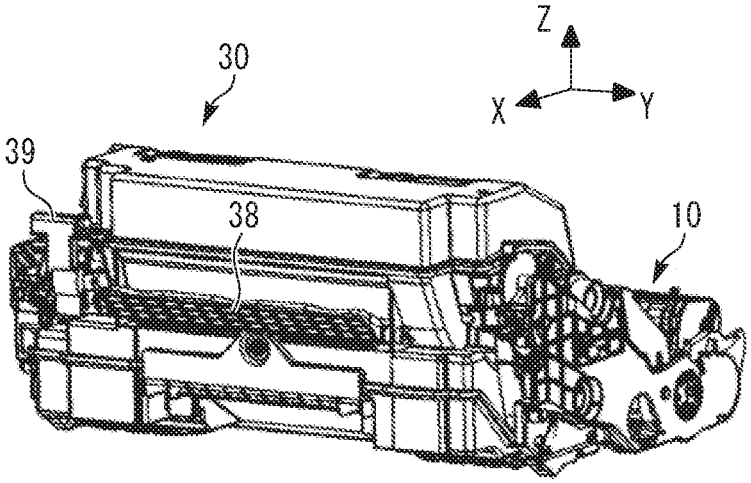
FIG. 4 is a perspective view illustrating the process cartridge to which the toner container is attached.
Figure 7:
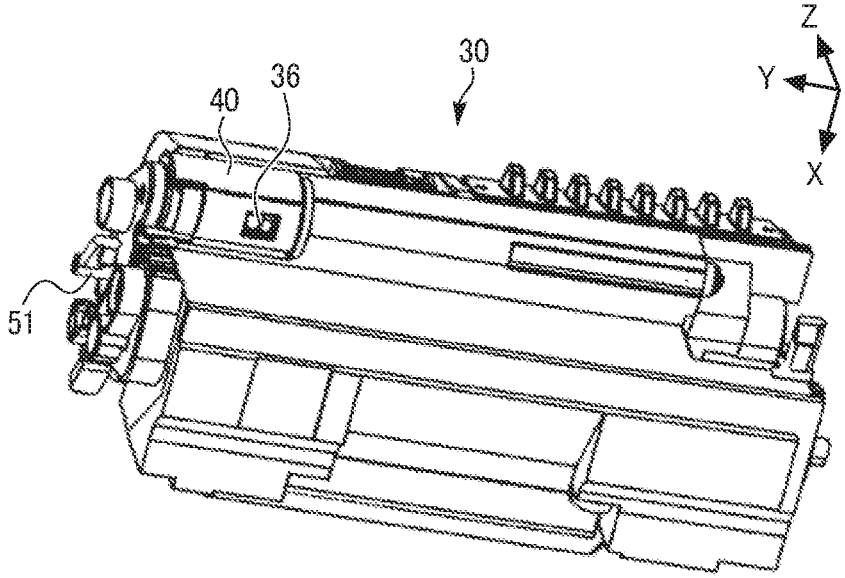
FIG. 7 is a perspective view illustrating the toner container with a first shutter (a discharge port) opened when viewed from below.

In the present embodiment, the cover 90 opened as illustrated in FIG. 3B reveals the toner container 30 serving as the powder container to be installable in and removable from the image forming apparatus 100. Opening the cover 90 enables replacing only the toner container 30 as illustrated in FIG. 7 with a new toner container or, alternatively, replacing the toner container 30 together with the process cartridge 10 with a new one that is the process cartridge 10 and the toner container 30 as illustrated in FIG. 4.

When the cover 90 closes as illustrated in FIG. 1, image forming processes that are printing operations described above with reference to FIG. 1 are performed.

The configuration and operations of the toner container 30 serving as the powder container according to the present embodiment are described in detail below.

In the present embodiment, as illustrated in FIG. 2, the toner container 30 as the powder container is attachable to and detachable from the process cartridge 10. In particular, in the present embodiment, the toner container 30 is attachable to and detachable from the process cartridge 10 in both states in which the process cartridge 10 is installed in the image forming apparatus 100 and in which the process cartridge 10 is removed from the image forming apparatus 100.

As described above with reference to FIG. 3B, the toner container 30 is attachable to and detachable from the process cartridge 10 installed in the image forming apparatus 100. In other words, the toner container 30 serving as the powder container is indirectly installable in and removable from the image forming apparatus 100. Thus, in the present embodiment, the toner container 30 can be said to be indirectly installable in and removable from the image forming apparatus 100. Alternatively, the toner container 30 may be directly installable in and removable from the image forming apparatus 100.

The process cartridge 10 is the removable component that is installable in and removable from the image forming apparatus 100. Besides the process cartridge 10, the developing device 5 and other devices may function as the removable components. The toner container 30 serving as the powder container may be attachable to and detachable from a removable component other than the process cartridge 10.

Figure 5:
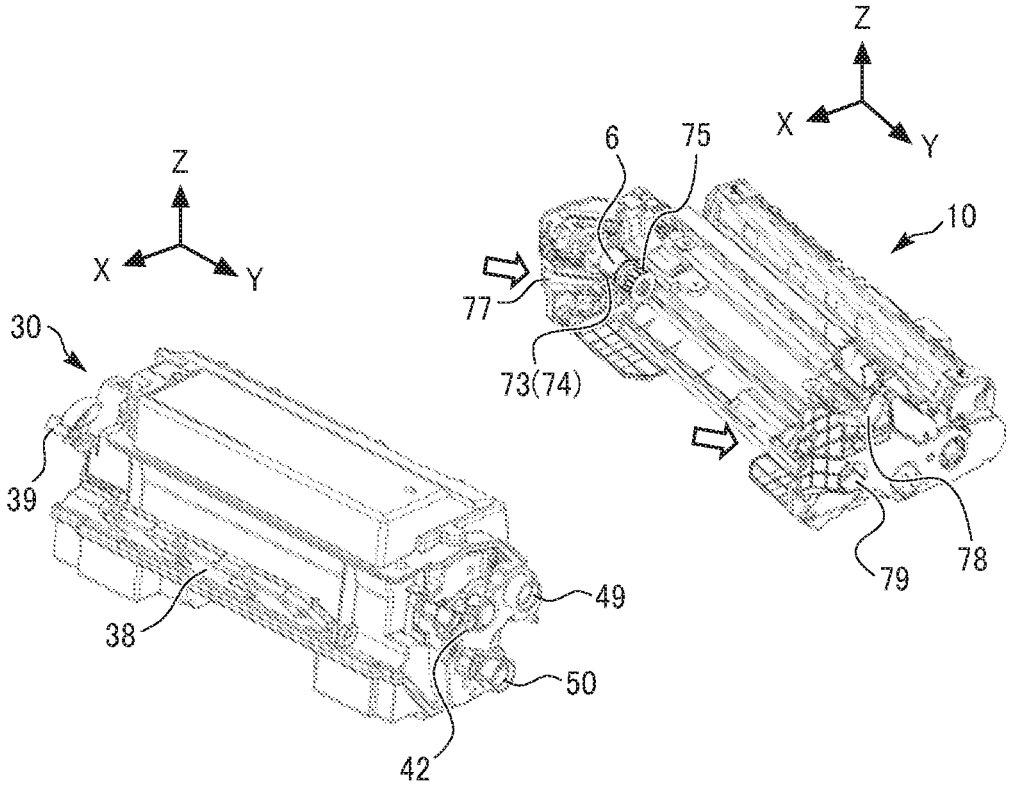
FIG. 5 is a perspective view illustrating the process cartridge from which the toner container is detached.
Figure 6A:
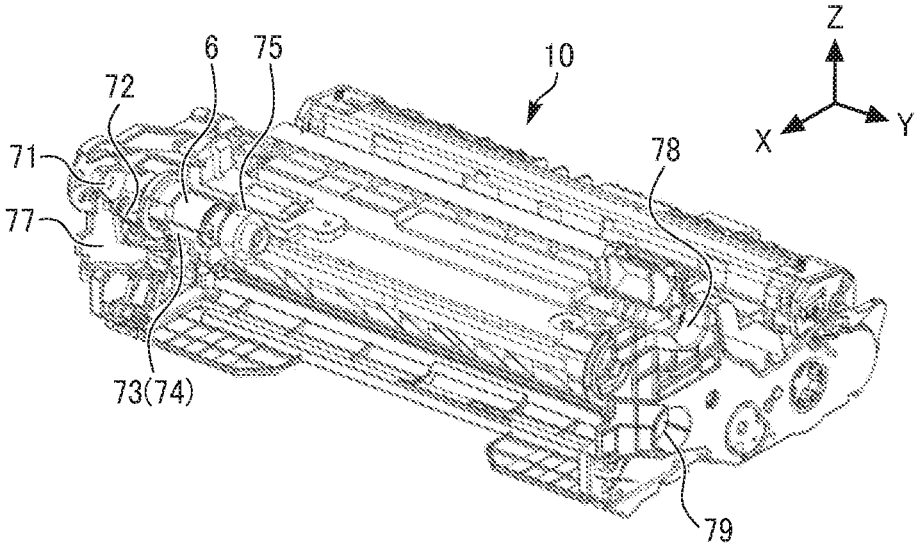
FIGS. 6A and 6B are perspective views of the process cartridge.
Figure 6B:
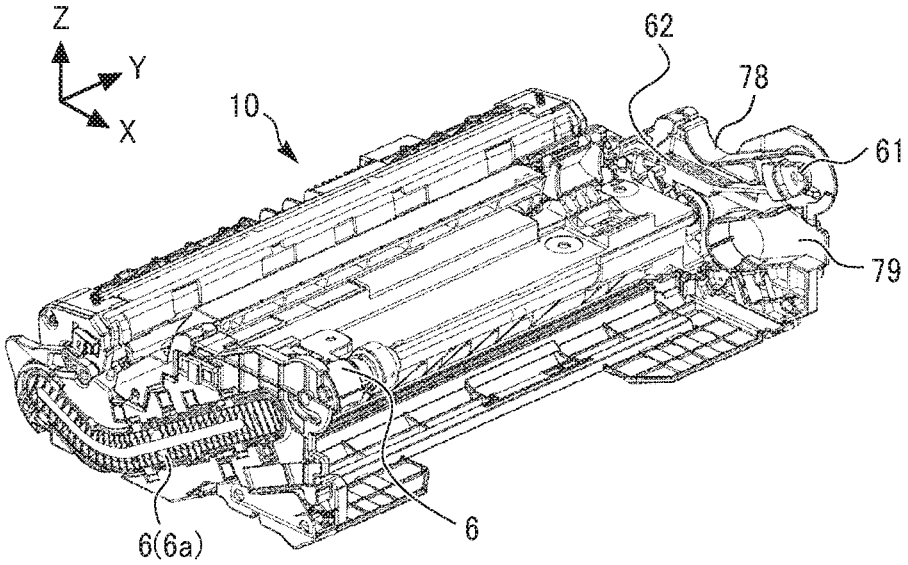

In addition, as illustrated in FIG. 4, the toner container 30 attached to the process cartridge 10 is installable in and removable from the image forming apparatus 100 as a single removable component. As illustrated in FIG. 5, the toner container 30 can be attached to the process cartridge 10, moving in a predetermined direction indicated by a fat arrow in FIG. 5. On the other hand, the toner container 30 can be removed from the process cartridge 10, moving in a direction opposite to the predetermined direction. The toner container 30 alone as illustrated in FIG. 7 is commercially available. The process cartridge 10 alone as illustrated in FIGS. 6A and 6B is similarly commercially available.

When the toner container 30 is attached to or detached from the process cartridge 10 (or the image forming apparatus 100), an operator, such as a user, pulls out or pushes in the toner container 30, while gripping a handle 38 of the toner container 30. The handle 38 is attached to the front side of the toner container 30 in a direction of detachment operation (positive X-direction) as illustrated FIGS. 2 to 5. The handle 38 is foldable. When the cover 90 closes in a state in which the toner container 30 is installed in the image forming apparatus 100 with the handle 38 standing up as illustrated in FIGS. 4 and 5, the handle 38 is pushed by the cover 90 in conjunction with movement of the cover 90 from an open state to a closed state, thereby accommodating the handle 38 along an exterior of the toner container 30.

The process cartridge 10 has multiple guide grooves 77 and 79, and a guide receiver 78 illustrated in FIG. 5. The first and second positioning portions 49 and 50 and the guide 51 engage with the guide receiver 78 and the multiple guide grooves 79 and 77, respectively. Thus, the toner container 30 can be attached to and detached from the process cartridge 10 and positioned in the process cartridge 10.

Specifically, the first and second positioning portions 49 and 50, which are positioning projections, project from one end face of the toner container 30 in the width direction of the toner container 30 (positive Y-direction). The guide receiver 78 and the guide groove 79 are formed on one end face of the process cartridge 10 corresponding to the one end face of the toner container 30. The guide 51 projects from the other end face of the toner container 30 (negative Y-direction) and has a rectangular shape which is inclined upward in positive X-direction. The guide receiver 78 introduces the first positioning portion 49, the guide groove 79 introduces the second positioning portion 50, and the guide groove 77 formed at the other end face of the process cartridge 10 introduces the guide 51. Thus, the toner container 30 is attached to the process cartridge 10. The toner container 30 is positioned in the process cartridge 10 so that the first and second positioning portions 49 and 50 engage with dead ends of the guide receiver 78 and the guide groove 79, respectively, and the guide 51 engages with a dead end of the guide groove 77.

The first positioning portion 49 is a projection surrounding a coupling that transmits driving force from the image forming apparatus 100 to a first agitator 33A (see FIGS. 2 and 9) to stir toner. The driving force input to the first agitator 33A is transmitted to the second agitator 33B via a gear train, and the first agitator 33A and the second agitator 33B rotate clockwise in FIG. 9.

Figure 9:
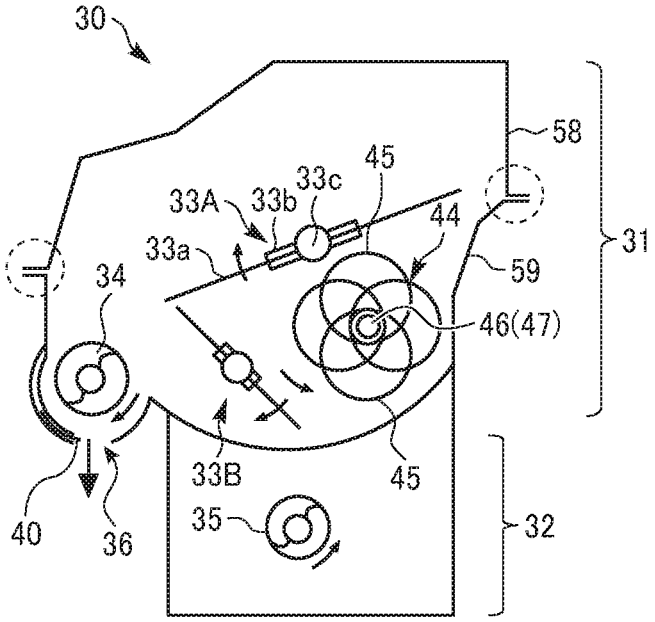
FIG. 9 is a schematic diagram illustrating an inside of the toner container.

The second positioning portion 50 is a projection surrounding a coupling gear to rotate a waste toner conveying screw 35 (see FIGS. 2 and 9). As described above, input portions to receive the driving force from the image forming apparatus 100 are disposed near or inside the first positioning portion 49 and the second positioning portion 50, enabling reliable driving force transmission.

The toner container 30 serving as the powder container includes the discharge port 36, a collection port 37, a first shutter 40, and a second shutter 41.

With reference to FIGS. 2, 7, and 9, the discharge port 36 of the toner container 30 is an opening for discharging toner as powder stored in the toner storage 31 of the toner container 30 to the developing device 5. The discharge port 36 communicates with the inlet port 64 of the developing device 5 when the toner container 30 is attached to the process cartridge 10. The inlet port 64 is an opening disposed above the conveying screw 5*c*.

Figure 8:
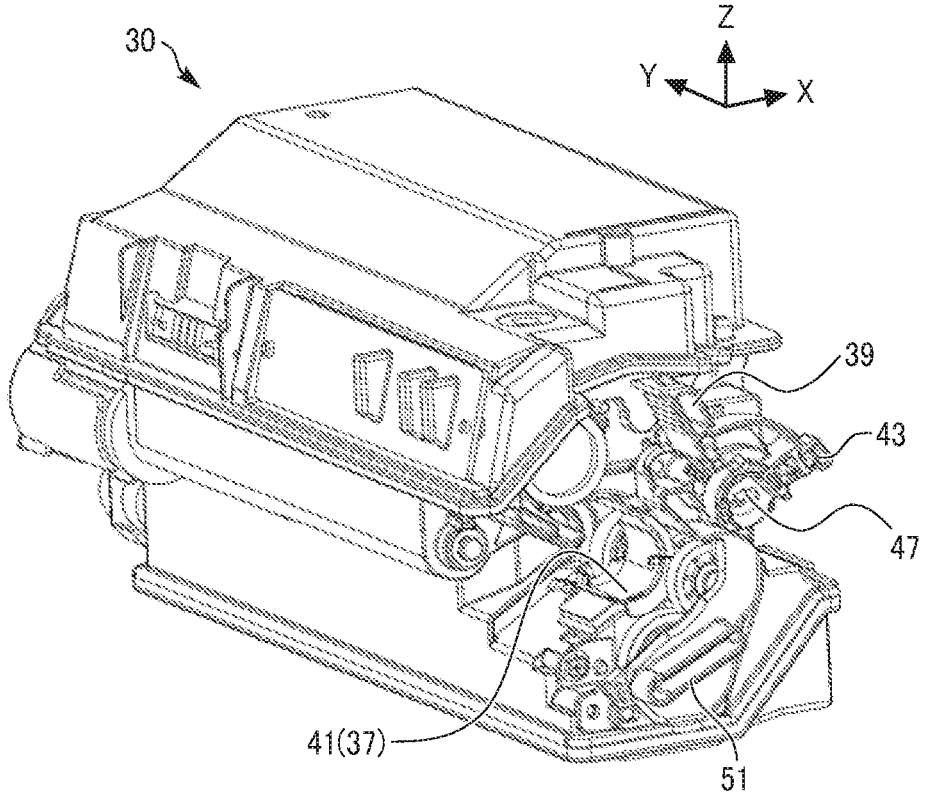
FIG. 8 is a perspective view illustrating the toner container with a second shutter (a collection port) closed when viewed from the collection port side.
Figure 10:
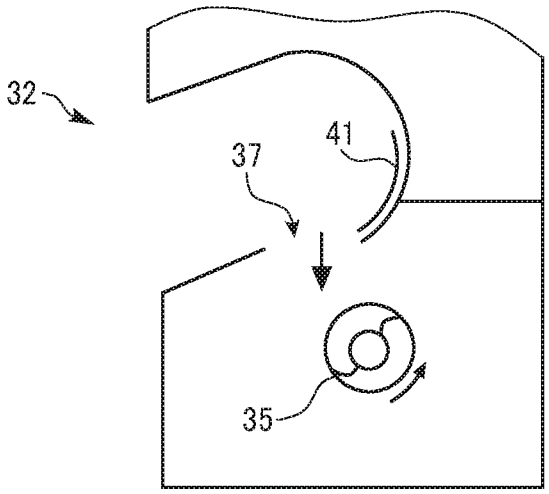
FIG. 10 is a schematic diagram illustrating a waste toner collection portion of the toner container.

With reference to FIGS. 2, 8, and 10, the collection port 37 of the toner container 30 is an opening to receive waste toner (untransferred toner) as powder from the outside of the toner container 30 and to collect the waste toner in the toner container 30. The collection port 37 communicates with the outlet port 74 of the waste toner conveyor 6 when the toner container 30 is attached to the process cartridge 10. The outlet port 74 (see FIGS. 5 and 6) is an opening disposed on a bottom face of a downstream end of the waste toner conveyor 6 in a direction of conveyance of the waste toner.

In the toner container 30 according to the present embodiment, with reference to FIGS. 2, 9, and 10, the toner storage 31 and the waste toner collection portion 32 are separated by a wall, the toner storage 31 is the powder storage to store toner as the powder to be discharged from the discharge port 36, and the waste toner collection portion 32 is the powder collection portion to collect the waste toner as the powder received from the collection port 37.

The toner storage 31 serving as the powder storage includes a supply screw 34 serving as a conveyer that rotates clockwise in FIGS. 2 and 9, the first agitator 33A and the second agitator 33B that rotate clockwise in FIGS. 2 and 9, and a coil-shaped agitator 44 that is rotated counterclockwise in FIGS. 2 and 9 by contact with the first agitator 33A.

The supply screw 34 serving as a conveyer discharges a target amount of toner stored in the toner storage 31 from the discharge port 36 according to a drive timing and rotation duration controlled by a controller. In the present embodiment, the supply screw 34 works as the conveyer that conveys the toner stored inside the toner storage 31 of the toner container 30 in a predetermined conveyance direction along the rotation axis direction that is a direction indicated by a broken line arrow in FIG. 18 and transports the toner to the discharge port 36 formed at the end portion in the Y direction.

The first agitator 33A and the second agitator 33B rotate in a predetermined direction about a rotation axis 33*c* (clockwise direction in FIGS. 2 and 9 in the present embodiment) and stir toner stored in the toner storage 31 to prevent toner from aggregating. As illustrated in FIG. 9, each of the first agitator 33A and the second agitator 33B includes a flap 33*a* that is a thin plate of such as plastic film and rotates about the rotation axis 33*c* serving as a rotation center, and a rigid portion 33*b* that is a plate disposed across the rotation axis 33*c* to sandwich and hold the flap 33*a*. A housing of the toner container 30 rotatably supports both ends of the first agitator 33A and both ends of the second agitator 33B in each of the axial directions through a pair of bearings. The flaps 33*a* of the first agitator 33A and the second agitator 33B have tip portions shaped like a comb that are free ends, which are described in detail later with reference to FIGS. 19 and 20.

The coil-shaped agitator 44 stirs toner in a region of the toner storage 31 where the first agitator 33A does not sufficiently stir toner. The coil-shaped agitator 44 includes a coil 45 including a plurality of divided coil portions 45*a* to 45*d* and a hollow member 46 that works as a shaft to hold the coil 45. A shaft 47 is inserted into the hollow member 46. The shaft 47 is a single component included in a mechanism to open and close the first shutter 40 and the second shutter 41 in conjunction with each other. The configuration of the above components is described in detail later with reference to FIGS. 15 and 16.

In the waste toner collection portion 32 serving as the powder collection portion, the waste toner conveying screw 35 that rotates counterclockwise in FIG. 2 is disposed. The waste toner conveying screw 35 conveys waste toner so that the waste toner that flows through the collection port 37 does not accumulate under the collection port 37 and is evenly distributed in the waste toner collection portion 32.

In the present embodiment, as an operator pivots a lever 39 of the toner container 30 attached to the process cartridge 10 (or the image forming apparatus 100), the first shutter 40 in the discharge port 36 and the second shutter 41 in the collection port 37 simultaneously open and close. In addition to the first shutter 40 and the second shutter 41, the inlet port 64 and the outlet port 74 of the process cartridge 10 also simultaneously open and close. Therefore, open and close failures are prevented in the first shutter 40, the second shutter 41, the first cartridge shutter 63, and the second cartridge shutter 73.

When the cover 90 opens in a state in which the toner container 30 is installed in the image forming apparatus 100, the lever 39 is revealed as illustrated in FIG. 3B so that the operator can operate the lever 39.

Figure 11:
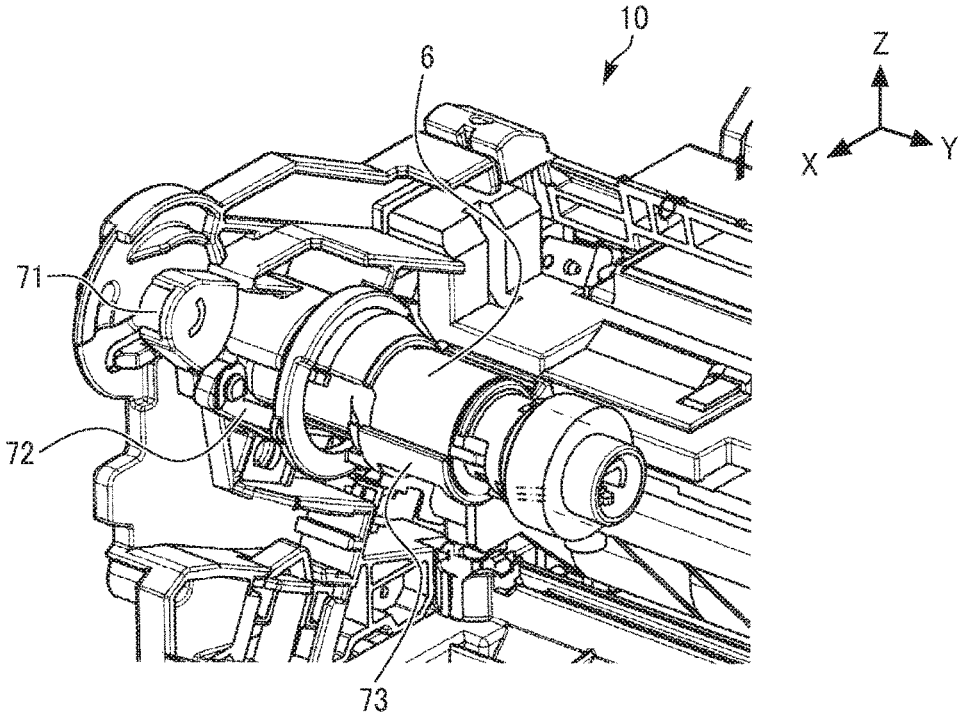
FIG. 11 is an enlarged perspective view illustrating a second engagement portion of the process cartridge.
Figure 12A:
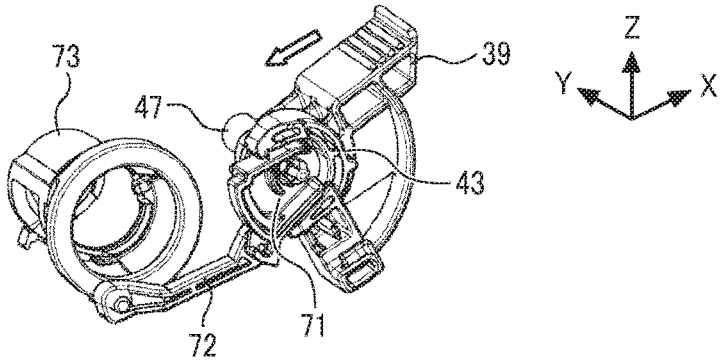
FIGS. 12A and 12B are perspective views illustrating a movement of a second cartridge shutter that opens and closes in the process cartridge.
Figure 12B:
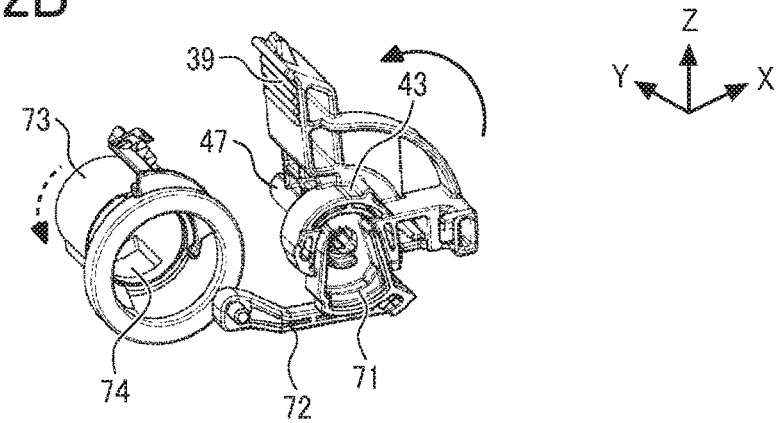

Specifically, as illustrated in FIGS. 8 and 12A, 12B, the toner container 30 further includes the lever 39 and a second rotation portion 43. The second rotation portion 43 is formed together with the lever 39 as a single unit to rotate along with the lever 39. The second rotation portion 43 is engageable with a second engagement portion 71 (see FIGS. 11 and 12A, 12B). The second engagement portion 71 is substantially arc-shaped and included in the process cartridge 10. Specifically, the second rotation portion 43 is shaped as a circle in which a part of the circle is missing in an arc shape. As illustrated in FIG. 12A, when the toner container 30 is attached to the process cartridge 10, the second engagement portion 71 of the process cartridge 10 is inserted in and engages with the second rotation portion 43 of the toner container 30. As illustrated in FIG. 12B, as the lever 39 rotates in a state in which the second engagement portion 71 of the process cartridge 10 engages with the second rotation portion 43 of the toner container 30, the second rotation portion 43 rotates along with the second engagement portion 71, thereby completing engagement of the process cartridge 10 and the toner container 30. Accordingly, the toner container 30 does not move in a direction of being pulled out from the process cartridge 10.

As the second rotation portion 43 is rotated along with the second engagement portion 71 by the lever 39 from a state illustrated in FIG. 12A to a state illustrated in FIG. 12B, a second link 72 coupled to the second engagement portion 71 of the process cartridge 10 moves in conjunction with the second engagement portion 71 in a direction to open the second cartridge shutter 73 of the process cartridge 10, thereby opening the outlet port 74. Further, the second cartridge shutter 73 that moves in the direction to open the second cartridge shutter 73 pushes the second shutter 41 in a direction to open the second shutter 41 of the toner container 30, thereby opening the collection port 37. As a result, the outlet port 74 of the process cartridge 10 communicates with the collection port 37 of the toner container 30. Thus, waste toner is delivered from the process cartridge 10 to the waste toner collection portion 32 of the toner container 30.

When the toner container 30 is detached from the process cartridge 10, the second rotation portion 43 rotates in a reverse direction opposite to the above-described direction along with a reverse rotation of the lever 39, and the second link 72 moves in conjunction with the second rotation portion 43, thereby closing the second cartridge shutter 73 in the outlet port 74 and the second shutter 41 in the collection port 37. As a result, the second rotation portion 43 of the toner container 30 disengages from the second engagement portion 71 of the process cartridge 10.

Figure 13:
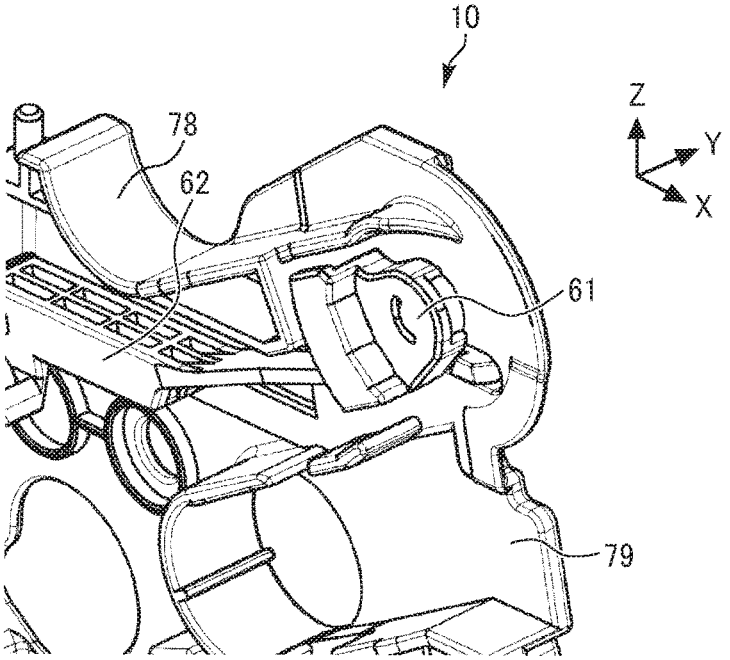
FIG. 13 is an enlarged perspective view illustrating a first engagement portion of the process cartridge.
Figure 14A:
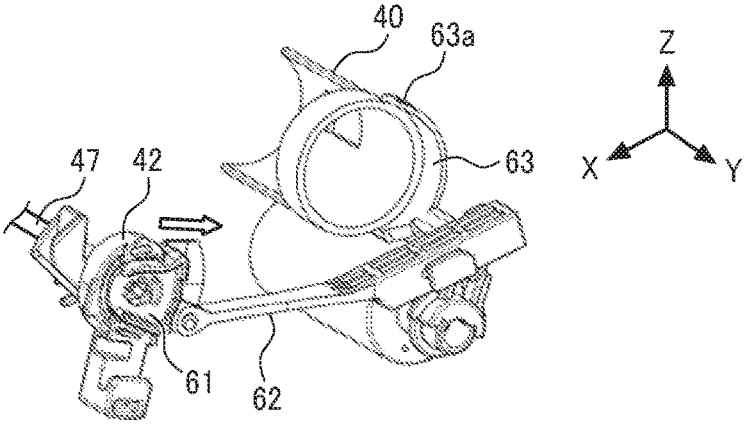
FIGS. 14A and 14B are perspective views illustrating a movement of a first cartridge shutter that opens and closes in the process cartridge.
Figure 14B:
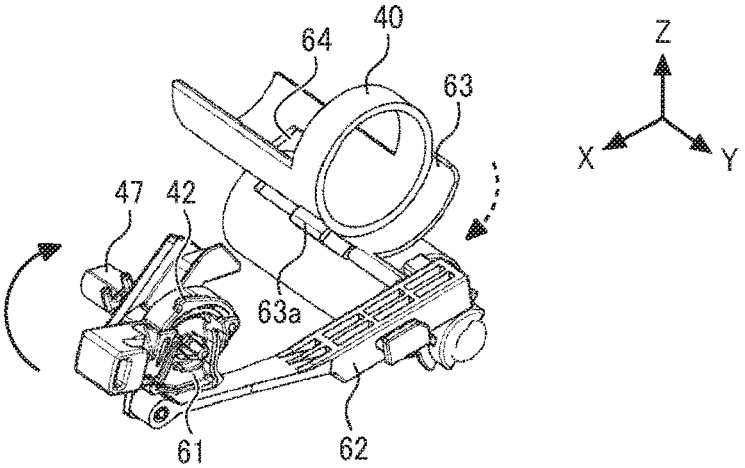

As illustrated in FIGS. 5, 14A, 14B, and 15, the toner container 30 further includes a first rotation portion 42 disposed opposite the lever 39 (and the second rotation portion 43) in the width direction of the toner container 30. The first rotation portion 42 is coupled to the second rotation portion 43 via the shaft 47 and rotates along with the lever 39 (, the second rotation portion 43, and the shaft 47). The first rotation portion 42 is engageable with a first engagement portion 61 (see FIGS. 13 and 14) that is substantially arc-shaped and included in the process cartridge 10. Specifically, the first rotation portion 42 is shaped as a circle in which a part of the circle is missing in an arc shape. As illustrated in FIG. 14A, when the toner container 30 is attached to the process cartridge 10, the first engagement portion 61 of the process cartridge 10 is inserted in and engages with the first rotation portion 42 of the toner container 30. As illustrated in FIG. 14B, as the lever 39 (and the second rotation portion 43) rotates in a state in which the first engagement portion 61 of the process cartridge 10 engages with the first rotation portion 42 of the toner container 30, the first rotation portion 42 rotates along with the first engagement portion 61 via the shaft 47, thereby completing engagement of the process cartridge 10 and the toner container 30. Accordingly, the toner container 30 does not move in a direction of being pulled out from the process cartridge 10.

As the first rotation portion 42 rotates along with the first engagement portion 61 by the lever 39 from a state illustrated in FIG. 14A to a state illustrated in 14B, a first link 62 coupled to the first engagement portion 61 of the process cartridge 10 moves in conjunction with the first engagement portion 61 in a direction to open a first cartridge shutter 63 of the process cartridge 10, thereby opening the inlet port 64. Further, a pushing portion 63*a* of the first cartridge shutter 63 that moves in the direction to open the first cartridge shutter 63 pushes the first shutter 40 in a direction to open the first shutter 40 of the toner container 30, thereby opening the discharge port 36. As a result, the inlet port 64 of the process cartridge 10 communicates with the discharge port 36 of the toner container 30. Thus, fresh toner is delivered from the toner storage 31 of the toner container 30 to the developing device 5 of the process cartridge 10.

When the toner container 30 is detached from the process cartridge 10, the first rotation portion 42 rotates in a reverse direction opposite to the above-described direction along with a reverse rotation of the lever 39, and the first link 62 moves in conjunction with the first rotation portion 42, thereby closing the first cartridge shutter 63 in the inlet port 64 and the first shutter 40 in the discharge port 36. As a result, the first rotation portion 42 of the toner container 30 disengages from the first engagement portion 61 of the process cartridge 10.

If the toner container 30 is installed in the image forming apparatus 100 in a state in which the lever 39 falls as illustrated in FIG. 5, the lever 39 is pushed by a pushing member 91 (see FIG. 3B) of the cover 90 in conjunction with movement of the cover 90 from the open state to the closed state, simultaneously causing the first shutter 40 to open the discharge port 36, the first cartridge shutter 63 to open the inlet port 64, the second shutter 41 to open the collection port 37, and the second cartridge shutter 73 to open the outlet port 74. Therefore, a set failure of the toner container 30 can be prevented.

The pushing member 91 is not fixed to the cover 90 in a standing state as illustrated in FIG. 3B. The pushing member 91 is foldable and switchable between the standing state and a falling state. The pushing member 91 is in the falling state at factory shipment. When the pushing member 91 is in the falling state, the lever 39 in the falling state as illustrated in FIG. 4 is not pushed by the pushing member 91 in the closed state of the cover 90. Accordingly, the discharge port 36 and the collection port 37 remain closed. The image forming apparatus 100 is shipped from a factory in a state in which the toner container 30 is installed in the image forming apparatus 100 with the discharge port 36 and the collection port 37 closed by the first and second shutters 40 and 41. Therefore, it is unnecessary to pack and ship the image forming apparatus 100 and the toner container 30 separately, and toner does not leak from the toner container 30 installed in the image forming apparatus 100 due to vibration during transport.

After arrival of the image forming apparatus 100, a user (or a service person) rotates the pushing member 91 to the standing state. This operation to rotate the pushing member 91 to the standing state is performed in a state in which the cover 90 is open (and the first and second shutters 40 and 41 remain closed). As the user (or the service person) only closes the cover 90 after standing the pushing member 91, the first shutter 40 and the second shutters 41 open. As a result, toner is supplied from the toner container 30 to the empty developing device 5, and the developing device 5 becomes available in use.

Figure 15:
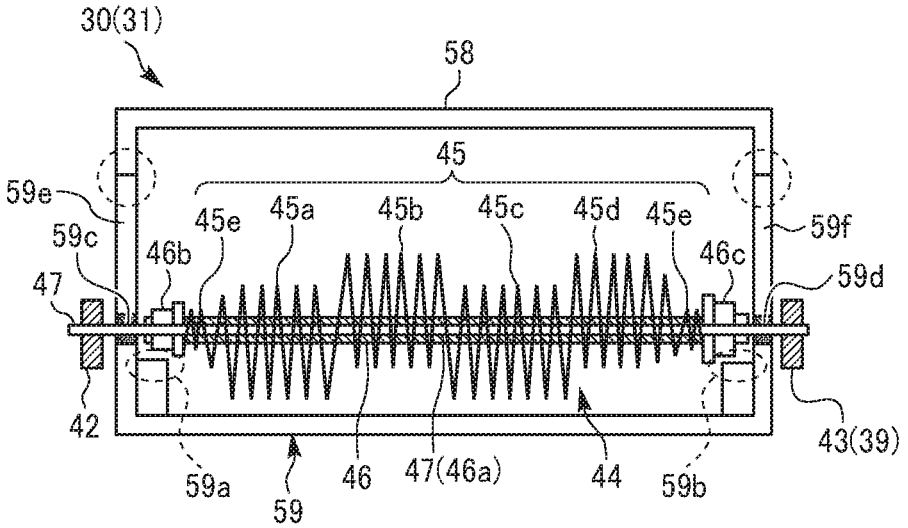
FIG. 15 a schematic diagram illustrating a toner storage of the toner container.
Figure 16:
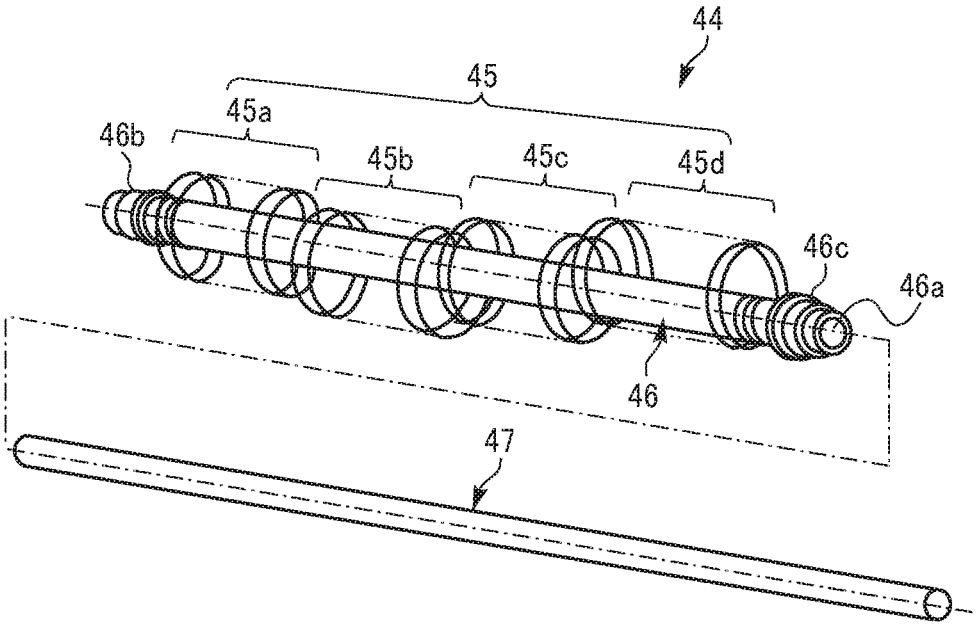
FIG. 16 is a perspective view illustrating a coil-shaped agitator provided in the toner container.
Figure 17:
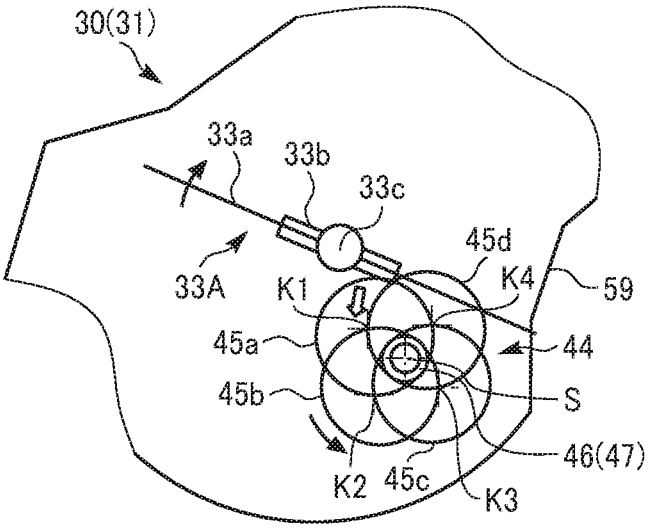
FIG. 17 is a schematic diagram illustrating a first agitator and the coil-shaped agitator.

With reference to FIGS. 15 to 17, the coil 45 is held by the hollow member 46 as the shaft having a shaft center coincident with a rotation center S of the coil 45. The coil 45 and the hollow member 46 constitute the coil-shaped agitator 44 to rotate around the rotation center S. In other words, the coil-shaped agitator 44 is a stirrer including the coil 45 and the hollow member 46 and stirs toner stored in the toner storage 31 of the toner container 30 together with the first agitator 33A and the second agitator 33B. In FIG. 17, the second agitator 33B is omitted for simplicity.

The first agitator 33A includes the rigid portion 33*b* as a contact part to contact the coil 45 and rotate the coil 45 and the coil-shaped agitator 44 and the flap 33*a* attached to the rigid portion 33*b*. The flaps 33*a* of the first agitator 33A and the second agitator 33B are flexible enough to bend when the flap 33*a* contacts the coil-shaped agitator 44 so as not to scratch the coil-shaped agitator 44 and stiff enough to stir toner stored in the toner storage 31.

Inside the hollow member 46 as the shaft of the coil-shaped agitator 44, a hollow part 46*a* extends in the axial direction of the coil-shaped agitator 44 (in the horizontal direction in FIG. 15 and the direction perpendicular to the surface of the paper on which FIG. 17 is drawn). Held parts 46*b* and 46*c* are disposed on one end of the coil-shaped agitator 44 and the other end of the coil-shaped agitator 44 in the axial direction of the coil-shaped agitator, respectively.

Specifically, the hollow member 46 is made of resin. The held parts 46*b* and 46*c* at the both ends of the coil-shaped agitator 44 have a larger outer diameter than the main part of the hollow member 46 that is a part around which the coil 45 winds). The hollow part 46*a* penetrates the hollow member 46 from the one end to the other end of the coil-shaped agitator 44. The held parts 46*b* and 46*c* are used when the coil-shaped agitator 44 or the shaft 47 is assembled to the toner container 30.

The hollow part 46*a* may be anything as long as the shaft 47 to be described later can be inserted into the hollow part 46*a* and is not limited to a closed space with a hollow space closed in the circumferential direction of the shaft 47 (not having openings except at both ends).

The coil 45 of the coil-shaped agitator 44 includes small coils 45*e* formed at both ends of the coil 45. The small coils 45*e* have the same inner diameter as the outer diameter of the hollow member 46 and fit into the hollow member 46. Thus, the coil 45 is held by the hollow member 46 so as to cover the hollow member 46.

The coil 45 rotates counterclockwise in FIG. 9 along with the hollow member 46 and functions as a main part of the coil-shaped agitator 44. The coil-shaped agitator 44 (the coil 45) stirs toner in a region of the toner storage 31 where the first agitator 33A does not sufficiently stir toner. The shaft 47 is disposed in the region to rotate the first and second rotation portions 42 and 43 in conjunction with each other. That is, if only the first agitator 33A stirs toner in the toner storage 31 without the coil-shaped agitator 44, the first agitator 33A contacts the shaft 47, thereby forming a dead space in which the first agitator 33 does not sufficiently stir toner (a region farther than the shaft 47 based on the first agitator 33A) in the toner storage 31. Therefore, toner staying in the dead space may be agglomerated, causing a toner supply failure. In the present embodiment, since the coil-shaped agitator 44 sufficiently stirs toner, such a dead space is not formed, thereby preventing toner from being agglomerated in the toner container 30 (the toner storage 31).

In the present embodiment, the shaft 47 is inserted into the hollow part 46*a* of the hollow member 46 included in the coil-shaped agitator 44. The shaft 47 and the coil-shaped agitator 44 (the hollow member 46) independently rotate each other.

Specifically, the shaft cross-section of the shaft 47 is circular, and the hole cross-section of the hollow part 46*a* of the hollow member 46 is circular. The hole cross-section has a slightly larger diameter than the shaft cross-section. With such a configuration, irrespective of the rotation of the coil-shaped agitator 44 to stir toner in the toner storage 31, the shaft 47 can be rotated by the lever 39 manually operated, thereby rotating the first and second rotation portions 42 and 43 (, the first and second shutters 40 and 41, and the first and second cartridge shutters 63 and 73) in conjunction with each other.

The coil 45 of the coil-shaped agitator 44 is driven by contact of the coil 45 with the first agitator 33A and rotates around the rotation center S.

Specifically, as the driving force is transmitted from the image forming apparatus 100 to the coupling disposed at an end of the first agitator 33A in the axial direction (see FIG. 17), the first agitator 33A and the second agitator 33B rotate clockwise in FIG. 17, and the rigid portion 33*b* of the first agitator 33A impacts the coil 45 including the plurality of divided coil portions 45*a* to 45*d*. The impact of the rigid portion 33*b* elastically deforms the coil 45 including the plurality of divided coil portions 45*a* to 45*d*, and the coil-shaped agitator 44 and the coil 45 rotate counterclockwise in FIG. 17 by repulsive force indicated by a fat arrow in FIG. 17, which is the force for the coil 45 to return to the original shape, thereby stirring toner. Since the rigid portion 33*b* of the first agitator 33A impacts the coil 45 including the plurality of divided coil portions 45*a* to 45*d* twice during one revolution of the first agitator 33A, the coil-shaped agitator 44 rotates slowly, and a rotational load of the first agitator 33A does not become too large.

Such a configuration that rotates the coil-shaped agitator 44 by contacting the first agitator 33A instead of gears can simplify a whole driving mechanism of the toner container 30.

In the present embodiment, even if the shaft 47 is disposed away from the shaft of the first agitator 33A, the dead space of toner is not formed in the toner storage 31. Accordingly, the opening and closing mechanism of the first and second shutters 40 and 41 (and the first and second cartridge shutters 63 and 73) can be freely laid out. Therefore, the flexibility of design can be improved.

Additionally, if the hollow member 46 completely covers the shaft 47, the shaft 47 that penetrates the toner storage 31 is not contaminated with toner.

As illustrated in FIGS. 15 to 17, the coil 45 according to the present embodiment is divided into the plurality of divided coil portions 45*a* to 45*d* in the axial direction of the coil-shaped agitator. The axial direction is the horizontal direction in FIG. 15 and the same as the width direction of the toner container 30.

As illustrated in FIG. 17, a plurality of coil centers K1 to K4 of the plurality of divided coil portions 45*a* to 45*d* are eccentric relative to the rotation center S that is the shaft axis of the hollow member 46. As illustrated in FIG. 17, the plurality of coil centers K1 to K4 of the plurality of divided coil portions 45*a* to 45*d* are disposed surrounding the rotation center S as viewed in the axial direction of the coil-shaped agitator 44.

A coil-shaped agitator having coils uniformly disposed in the axial direction instead of the coils eccentrically disposed on a concentric circle of an outer periphery of the hollow member 46 easily causes a disadvantage that the coils near the center in the axial direction that collides the first agitator 33A bend and are buried in toner in the toner storage 31, and the coil-shaped agitator stops rotation or does not smoothly rotate. In other words, a part of the coil remains deformed and causes a stirring failure such as rotation stop.

In the present embodiment, four divided coil portions 45*a* to 45*d* are eccentric in different directions, respectively, thereby preventing the above-described inconvenience.

Additionally, in the present embodiment, the rigid portion 33*b* of first agitator 33A impacts one of the four divided coil portions 45*a* to 45*d*, thereby reducing a load of impact.

With reference to FIG. 15, the toner storage 31 in the toner container 30 further includes holders 59*a* and 59*b* to hold the held parts 46*b* and 46*c* of the hollow member 46 at one end of the coil-shaped agitator 44 and the other end of the coil-shaped agitator 44 in the axial direction, respectively, thereby holding the coil-shaped agitator 44.

The shaft 47 is inserted into the hollow part 46*a* of the hollow member 46 from the outside of the toner container 30 through a through-hole 59*d* and holds the coil-shaped agitator 44 while the coil-shaped agitator 44 is held by the holders 59*a* and 59*b*.

Specifically, the toner storage 31 in the toner container 30 can be divided into an upper case 58 and a lower case 59 as illustrated in FIGS. 9 and 15. The lower case 59 is a box-shaped case including a bottom, and side walls 59*e*, 59*f*, and the like, surrounding the four sides of the bottom. The upper case 58 engages with the lower case 59 at positions indicated by dashed circles in FIGS. 9 and 15 so that the upper case 58 covers the upper opening of the lower case 59. The holders 59*a* and 59*b* and the through-holes 59*c* and 59*d* are provided in the lower case 59.

More specifically, the holders 59*a* and 59*b* are disposed inside the two side walls 59*e* and 59*f* located at both ends of the lower case 59 in the axial direction of the coil-shaped agitator 44 and have a concave shape facing upward. The holders 59*a* and 59*b* have an arc-shaped cross-section.

With reference to FIG. 15, the through-holes 59*c* and 59*d* are disposed in the two side walls 59*e* and 59*f* located at the both ends of the lower case 59 in the axial direction of the coil-shaped agitator 44 and at positions higher than the holders 59*a* and 59*b*, that is, the positions above the holders 59*a* and 59*b* to penetrate the side walls 59*e* and 59*f*. In the present embodiment, the through-holes 59*c* and 59*d* are holes of bearings and indirectly formed in the side walls 59*e* and 59*f*. Alternatively, through-holes may be directly formed in the side walls 59*e* and 59*f*. Packing, such as G seals, V rings, or the like, are preferably provided with the through-holes 59*c* and 59*d* to prevent toner from leaking through a gap between the shaft 47 and the through-holes 59*c* and 59*d*.

A length of the coil-shaped agitator 44 is shorter than a distance between inner surfaces of the two side walls 59*e* and 59*f* in the axial direction of the coil-shaped agitator 44. A length of the shaft 47 is longer than a distance between outer surfaces of the two side walls 59*e* and 59*f* in the axial direction of the coil-shaped agitator 44.

In the process of manufacturing the toner container 30, the coil-shaped agitator 44 is placed in the lower case 59 with the upper case 58 removed so that the held parts 46*b* and 46*c* of the hollow member 46 fit to the holders 59*a* and 59*b* of the lower case 59.

The shaft 47 is inserted into the hollow part 46*a* of the coil-shaped agitator 44 placed in the lower case 59, from the outside of the toner container 30 through one of the through-holes 59*c* and 59*d* of the two side walls 59*e* and 59*f*. Then, the shaft 47 penetrates the through-holes 59*c* and 59*d* of the two side walls 59*e* and 59*f* and is held by the lower case 59.

Thus, the toner container 30 according to the present embodiment includes the shaft 47 that is inserted into the hollow part 46*a* of the hollow member 46 from the outside of the toner container 30 through the through-hole 59*d* and holds the coil-shaped agitator 44 while the coil-shaped agitator 44 is held by the holders 59*a* and 59*b*.

Therefore, although the coil-shaped agitator 44 is rotatably held in the box-shaped toner container 30, inconveniences, such as that it takes time and effort to assemble the toner container 30 or an assembly failure that occurs in the manufacturing process, do not occur, thereby improving assembly efficiency of the toner container 30.

Since the coil-shaped agitator 44 according to the present embodiment includes the coil 45, when an operator inserts the shaft 47 into the inside of the coil 45 from the outside of the toner container 30 that does not include the hollow member 46 and the holders 59*a* and 59*b* to assemble the toner container 30, the operator has to hold the coil 45 by hand and inserts the shaft 47 into the inside of the coil 45, which causes noticeable inconvenience in that the shaft 47 is entangled with the coil 45. Additionally, without the hollow member 46, the shaft 47 is more likely to be entangled with the divided coil portions 45*a* to 45*d* whose centers eccentrically disposed in all directions when the shaft 47 is inserted.

On the other hand, in the present embodiment, since the shaft 47 moves inside the hollow member 46 in series of operations in which the shaft 47 is inserted into the coils 45 of the coil-shaped agitator 44, the shaft 47 is not entangled with the coil 45. Therefore, the assembly efficiency of the toner container 30 is improved.

A distinctive configuration and an operation of the toner container 30 serving as the powder container according to the present embodiment are described below.

As described above with reference to FIG. 9, the toner container 30 serving as the powder container according to the present embodiment includes the flap 33*a* that rotates about the rotation axis 33*c*. This flap 33*a* constitutes the first agitator 33A and the second agitator 33B together with the rigid portion 33*b*. In the present embodiment, two flaps 33*a* (the first agitator 33A and the second agitator 33B) are disposed in the toner storage 31.

The first agitator 33A and the second agitator 33B are different in overall size, installation position, number of teeth of tip portions having teeth like comb, and the like, but the first agitator 33A and the second agitator 33B include the flaps 33*a* and the rigid portions 33*b* and have a similar structure, so some of the explanation is omitted as appropriate.

Figure 18:
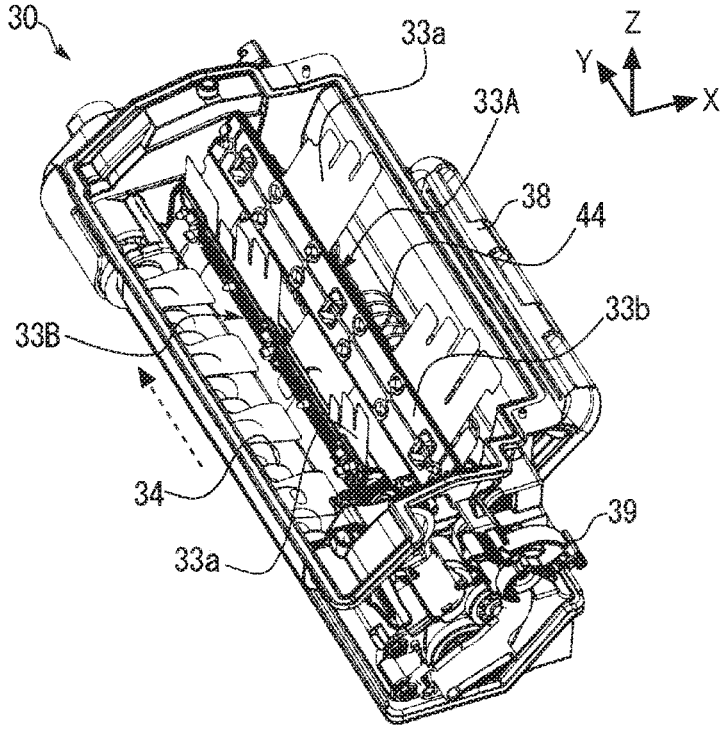
FIG. 18 is a perspective view illustrating an inside of the toner storage of the toner container.
Figure 19:
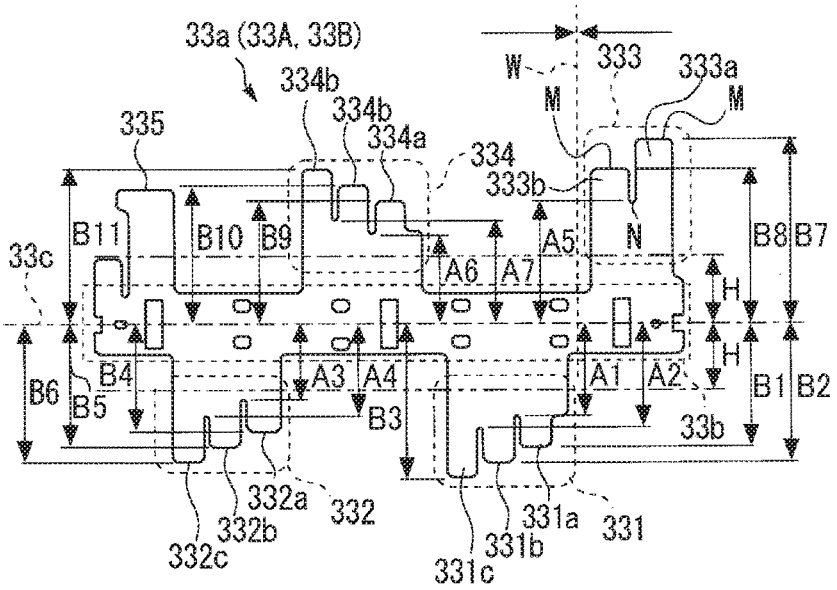
FIG. 19 is a plan view illustrating a flap to which an external force is not applied.

As illustrated in FIGS. 18 and 19, the first agitator 33A and the second agitator 33B are configured by the flap 33*a* that is made of the thin plate such as the plastic film and two rigid portions 33*b* that are plates, sandwich a central portion of the shorter side of the flap 33*a*, and form a joint. A central portion of the shorter side of the rigid portion 33*b* becomes the rotation axis 33*c*, and the flap 33*a* (the first agitator 33A and the second agitator 33B) rotates around the rotation axis 33*c*.

The flap 33*a* has comb-teeth tip portions 331 to 334 that have teeth like comb teeth and are slidable on the inner wall surface of the case 59 of the toner storage 31 in the toner container 30. As illustrated in FIG. 19, the flap 33*a* in the present embodiment includes four comb-teeth tip portions 331 to 334 and one non-comb-teeth tip portion 335 that is a tip portion not having the teeth like comb teeth. Then, the tip portions 331 to 335 agitate the toner as the free end of the flap 33*a* of the first agitator 33A.

Each of the four comb-teeth tip portions 331 to 334 is formed with a plurality of teeth aligned in the direction of the rotation axis with the notches therebetween. Specifically, a first comb-teeth tip portion 331 has three teeth 331*a* to 331*c*, a second comb-teeth tip portion 332 has three teeth 332*a* to 332*c*, a third comb-teeth tip portion 333 has three teeth 333*a* to 333*c*, and a fourth comb-teeth tip portion 334 has three teeth 334*a* to 334*c*.

Figure 20:
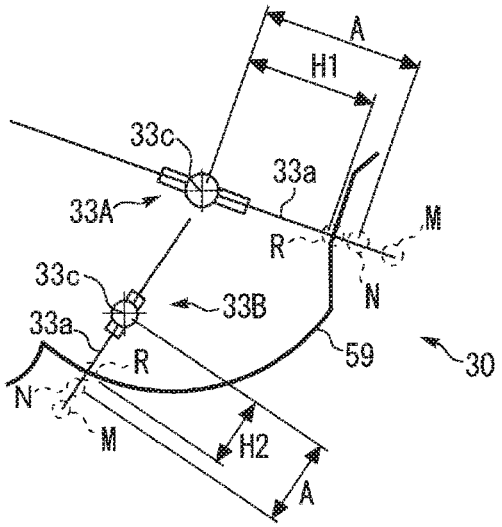
FIG. 20 is a schematic diagram illustrating relative positions of an inner wall surface of the toner container and the flap.

With reference to FIG. 20, in the comb-teeth tip portions 331 to 334 of the flap 33*a*, a distance A from a root N between adjacent teeth (an end part of the notch) to the rotation axis 33*c* when the comb-teeth tip portion does not contact the inner wall surface of the case 59 is longer than distances H1 and H2. (A>H1, A>H2). The distances H1 and H2 are shortest distances between the rotation axes 33*c* and the inner wall surface of the case 59 in the first agitator 33A and the second agitator 33B, respectively. Note that FIG. 20 illustrates a hypothetical state in which the flap 33*a* does not bend on the inner wall surface of the case 59 of the toner container 30 to easily illustrate the distance A when the comb-teeth tip portion does not contact the inner wall surface of the case 59.

Specifically, with reference to FIGS. 19 and 20, in the first comb-teeth tip portion 331, a distance A1 from the root N between a right tooth 331*a* and a center tooth 331*b* to the rotational axis 33*c* is longer than the shortest distance H between the rotation axis 33*c* and the inner wall surface (A1>H), and a distance A2 from the root N between a center tooth 331*b* and a left tooth 331*c* to the rotational axis 33*c* is longer than the shortest distance H between the rotation axis 33*c* and the inner wall surface (A2>H). Similarly, in the second comb-teeth tip portion 332, a distance A3 from the root N between a right tooth 332*a* and a center tooth 332*b* to the rotational axis 33*c* is longer than the shortest distance H between the rotation axis 33*c* and the inner wall surface (A3>H), and a distance A4 from the root N between a center tooth 333*b* and a left tooth 332*c* to the rotational axis 33*c* is longer than the shortest distance H between the rotation axis 33*c* and the inner wall surface (A4>H). Additionally, in the third comb-teeth tip portion 333, a distance A5 from the root N between a right tooth 333*a* and a left tooth 333*b* to the rotational axis 33*c* is longer than the shortest distance H between the rotation axis 33*c* and the inner wall surface (A5>H). In addition, in the fourth comb-teeth tip portion 334, a distance A6 from the root N between a right tooth 334*a* and a center tooth 334*b* to the rotational axis 33*c* is longer than the shortest distance H between the rotation axis 33*c* and the inner wall surface (A6>H), and a distance A7 from the root N between a center tooth 334*b* and a left tooth 334*c* to the rotational axis 33*c* is longer than the shortest distance H between the rotation axis 33*c* and the inner wall surface (A7>H).

That is, the distances A1 to A7 from any root N between adjacent teeth to the rotational axis 33*c* are longer than the shortest distance H between the rotation axis 33*c* and the inner wall surface (A1 to A7>H).

With such a configuration, the flap 33*a* of each of the first agitator 33A and the second agitator 33B sufficiently agitates toner in the toner storage 31.

Figure 21A:
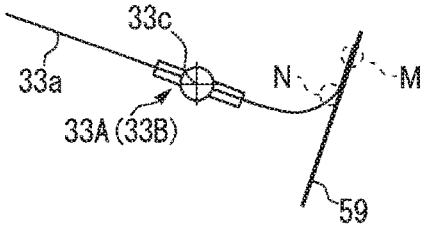
FIGS. 21A and 21B are schematic diagrams illustrating the flap that slides on the inner wall surface of the toner container.
Figure 21B:
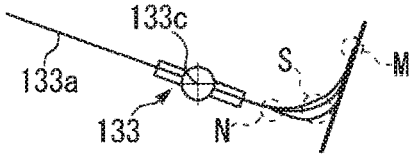

Specifically, as illustrated in FIG. 21B, an agitator 133 as a comparative example that has a plurality of long notches formed in the flap 133*a*, which means the distances from the roots N between the adjacent teeth to the rotation axis 133*c* are short, greatly bends, and a plurality of teeth in the comb-teeth tip portion are loosely bent when the flap 133*a* slides on the inner wall surface of the case 59 of the toner container 30. Therefore, a large clearance S is formed between the teeth in the comb-teeth tip portion, and the toner slips through the clearance S, which causes a disadvantage that the flap 133*a* does not sufficiently agitate the toner in the toner container. In such a case, the toner in the toner container aggregates, which may cause toner supply troubles, abnormal images, and the like.

In contrast, as illustrated in FIG. 21A, since the agitator according to the present embodiment has a plurality of short notches formed in the flap 33*a*, which means the distances A from the roots N between the adjacent teeth to the rotation axis 33*c* are long, and a tooth depth of each of the plurality of teeth in the comb-teeth tip portions 331 to 334, which is a length in a radial direction of the agitator, is short, the plurality of teeth in the comb-teeth tip portions 331 to 334 are not loosely bent when the flap 33*a* slides on the inner wall surface of the case 59 of the toner container 30. Therefore, the disadvantage is less likely occur which is caused when the large clearance is formed between the teeth in the comb-teeth tip portions 331 to 334, and the toner slips through the clearance, and the flap 33*a* sufficiently agitate the toner in the toner container.

In addition, when the flap having the tip portions which are free ends not shaped like the comb, which is different from the flap 33*a* in the present embodiment, contacts, slides, and greatly bends on the inner wall surface of the case 59 of the toner container and separates from the inner wall surface of the case 59, recoil when the bent flap returns to its original shape causes a relatively loud noise.

In contrast, since the flap 33*a* in the present embodiment has tip portions 333 and 334 shaped like the comb that are free ends, the recoil when the bent flap returns to its original shape is distributed, and the loud noise is reduced.

In the flap 33*a* according to the present embodiment, that is, in the first agitator 33A and the second agitator 33B, distances from tooth tips M of adjacent teeth to the rotation axis 33*c* are differently formed when the comb-teeth tip portions 331 to 334 do not contact the inner wall surface of the case 59.

Specifically, with reference to FIG. 19, in the first comb-teeth tip portion 331, a distance B1 from the tooth tip M of the right tooth 331*a* to the rotation axis 33*c* is shorter than a distance B2 from the tooth tip M of the center tooth 331*b* to the rotation axis 33*c*, and a distance B3 from the tooth tip of the left tooth 331*c* to the rotation axis 33*c* is longest (B1<B2<B3). Similarly, in the second comb-teeth tip portion 332, a distance B4 from the tooth tip M of the right tooth 332*a* to the rotation axis 33*c* is shorter than a distance B5 from the tooth tip M of the center tooth 332*b* to the rotation axis 33*c*, and a distance B6 from the tooth tip of the left tooth 332*c* to the rotation axis 33*c* is longest (B4<B5<B6). Additionally, in the third comb-teeth tip portion 333, a distance B7 from the tooth tip M of the right tooth 333*a* to the rotation axis 33*c* is longer than a distance B8 from the tooth tip M of the left tooth 333*b* to the rotation axis 33*c* (B7>B8). In addition, in the fourth comb-teeth tip portion 334, a distance B9 from the tooth tip M of the right tooth 334*a* to the rotation axis 33*c* is shorter than a distance B10 from the tooth tip M of the center tooth 334*b* to the rotation axis 33*c*, and a distance B11 from the tooth tip of the left tooth 334*c* to the rotation axis 33*c* is longest (B9<B10<B11).

The noise caused by the comb-teeth tip portions 331 to 334 formed as described above so that the distances from the tooth tips M in the adjacent teeth to the rotation axis 33*c* are different is smaller than the noise caused by the tip portions formed so that the distances from the tooth tips in the adjacent teeth to the rotation axis are equal because the plurality of teeth included in the comb-teeth tip portions, at different timings, separate from the inner wall surface of the case 59, and the bent tip portions return to the original shapes at different timings.

As illustrated in FIG. 20 and the like, in the present embodiment, the flap 33*a* is formed to extend in a plurality of different radial directions from the rotation axis 33*c*.

Specifically, the flaps 33*a* are respectively formed in two directions shifted by 180 degrees in the rotation direction with the rotation axis 33*c* interposed therebetween. In other words, the first agitator 33A and the second agitator 33B are formed such that the flaps 33*a* extend in two directions shifted by 180 degrees in the rotation direction, with the rotation axis 33*c* interposed therebetween. The first comb-teeth tip portion 331 and the second comb-teeth tip portion 332 are disposed in one radial direction, and the third comb-teeth tip portion 333 and the fourth comb-teeth tip portion 334 are disposed in the other radial direction.

Providing the flaps in a plurality of directions as described above, that is, providing the comb-teeth tip portions 331 to 334 in the plurality of directions enables the first agitator 33A and the second agitator 33B to stir the toner in the toner container a plurality of times while the first agitator 33A and the second agitator 33B make one revolution. Therefore, toner aggregation can be efficiently prevented.

Further, in the flap 33*a* according to the present embodiment, a plurality of comb-teeth portions of the plurality of comb-teeth tip portions 331 to 334 in each of the plurality of radial directions are disposed at intervals in the rotation axis direction. Among the plurality of comb-teeth tip portions 331 to 334A, a plurality of comb-teeth tip portions formed in adjacent radial directions of the plurality of radial directions are alternately disposed so as not to be located in the same range in the rotation axis direction.

Specifically, as illustrated in FIG. 19, from the left, the second comb-teeth tip portion 332 is formed at one radial direction which is the lower side in FIG. 19, the fourth comb-teeth tip portion 334 is formed at the other radial direction which is the upper side in FIG. 19, the first comb-teeth tip portion 331 is formed at the one radial direction which is the lower side in FIG. 19, and the third comb-teeth tip portion 333 is formed at the other radial direction which is the upper side in FIG. 19. That is, the comb-teeth tip portions 331 to 334 are alternately formed in the vertical direction of FIG. 19.

Alternately arranging the plurality of comb-teeth tip portions 331 to 334 in the different radial directions as described above can lead load variation while the first agitator 33A and the second agitator 33B make one rotation to smaller than arranging all of the plurality of comb-teeth tip portions in the same radial direction.

Furthermore, in the present embodiment, the plurality of comb-teeth tip portions 331 to 334 are each formed such that the distances B from the respective tooth tips M of the plurality of teeth to the rotation axis 33*c* are all different.

Specifically, as described above with reference to FIG. 19, the relationship of B1≠B2≠B3 is established in the first comb-teeth tip portion 331, the relationship of B4≠B5≠B6 is established in the second comb-teeth tip portion 332, the relationship of B7≠B8 is established in the third comb-teeth tip portion 333, and the relationship of B9≠B10≠B11 is established in the fourth comb-teeth tip portion 334.

The noise caused by the above-described configuration is smaller than the noise caused by the configuration having a plurality of teeth in which the distances from tooth tips M to the rotation axis 33*c* are equal because all the plurality of teeth included in the comb-teeth tip portions 333 and 334, at different timings, separate from the inner wall surface of the case 59, and all the bent tip portions return to the original shapes at different timings.

In the present embodiment, the plurality of comb-teeth tip portions 331 to 334 are formed such that averages calculated by the distances B from the tooth tips M to the rotation axis 33*c* in the plurality of teeth of each comb-teeth tip portion in the same radial direction are different each other.

Specifically, as described with reference to FIG. 19, in one radial direction, the average calculated by the distances from the tooth tips M of the plurality of teeth in the first comb-teeth tip portion 331 to the rotation axis 33*c*, that is, (B1+B2+B3)/3 is different from the average calculated by the distances from the tooth tips M of the plurality of teeth in the second comb-teeth tip portion 332 to the rotation axis 33*c*, that is, (B4+B5+B6)/3. That is, the relationship of (B1+B2+B3)/3≠(B4+B5+B6)/3 is established.

Similarly, in the other radial direction, the average calculated by the distances from the tooth tips M of the plurality of teeth in the third comb-teeth tip portion 333 to the rotation axis 33*c*, that is, (B7+B8)/2 is different from the average calculated by the distances from the tooth tips M of the plurality of teeth in the fourth comb-teeth tip portion 334 to the rotation axis 33*c*, that is, (B9+B10+B11)/3. That is, the relationship of (B7+B8)/2 (B9+B10+B11)/3 is established.

The noise caused by the above-described configuration is smaller than the noise caused by the configuration in which averages calculated by the distances B from the tooth tips M to the rotation axis 33*c* in the plurality of teeth of each comb-teeth tip portion in the same radial direction are equal because the plurality of comb-teeth tip portions provided in the same radial direction, at different timings, separate from the inner wall surface of the case 59, and all the bent tip portions return to the original shapes at different timings.

In the present embodiment, the first comb-teeth tip portion 331, the second comb-teeth tip portion 332, and the fourth comb-teeth tip portion 334 are formed such that distances A from the roots N between the adjacent teeth to the rotation axis 33*c* are different when the comb-teeth tip portions do not contact the inner wall surface of the case 59.

Specifically, as described above with reference to FIG. 19, the relationship of A1≠A2 is established in the first comb-teeth tip portion 331, the relationship of A3≠A4 is established in the second comb-teeth tip portion 332, and the relationship of A6≠A7 is established in the fourth comb-teeth tip portion 334.

The above-described configuration can prevent toner to slip through the clearance between the teeth because the clearance between the teeth in the plurality of teeth formed such that the distances B from the rotation axis 33*c* to the tooth tips M are different in the above-described configuration can set smaller than the one in the configuration formed such that distances A from the roots N between adjacent teeth to the rotation axis 33*c* are equal.

As described above with reference to FIGS. 9, 18 and the like, the toner storage 31 of the toner container 30 according to the present embodiment includes the supply screw 34 serving as the conveyer to convey the toner stored in the toner storage 31 of the toner container 30 in the predetermined conveyance direction along the rotation axis direction.

In the present embodiment, the discharge port 36 is disposed at a position in the rotation axis direction indicated by a broken line W in FIG. 19 with respect to the flap 33*a*. The supply screw 34 is configured to convey the toner from the left side in FIG. 19 toward the broken line W and convey the toner from the right side toward the broken line W by adjusting the winding direction of the screw spirally wound around the shaft.

Furthermore, in the present embodiment, the plurality of comb-teeth tip portions 331 to 334 are each formed such that the distances B from the respective tooth tips M of the plurality of teeth to the rotation axis 33*c* gradually decrease from the upstream side to the downstream side in the conveyance direction of the supply screw 34.

Specifically, with reference to FIG. 19, the first comb-teeth tip portion 331, the second comb-teeth tip portion 332, and the fourth comb-teeth tip portion 334, which are disposed at left from the broken line W, are formed such that the distances B from the respective tooth tips M to the rotation axis 33*c* gradually decrease from the left side to the right side. That is, the first comb-teeth tip portion 331, the second comb-teeth tip portion 332, and the fourth comb-teeth tip portion 334 are configured such that the relationship of B3>B2>B1, B6>B5>B4, and B11>B10>B9 is established in each of the first comb-teeth tip portion 331, the second comb-teeth tip portion 332, and the fourth comb-teeth tip portion 334.

On the other hand, the third comb-teeth tip portion 333, which is disposed at right from the broken line W, is formed such that the distances B from the respective tooth tips M to the rotation axis 33*c* gradually decrease from the right side to the left side. That is, the third comb-teeth tip portion 333 is configured such that the relationship of B7>B8 is established.

Since the toner easily flows in a direction in which the distances B from the tooth tips M to the rotation axis 33*c* gradually decrease, this configuration promotes the toner conveyance by the supply screw 34 described above.

Variation.

Figure 22A:
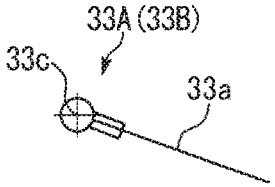
FIGS. 22A and 22B are schematic diagrams illustrating the agitator according to a variation.
Figure 22B:
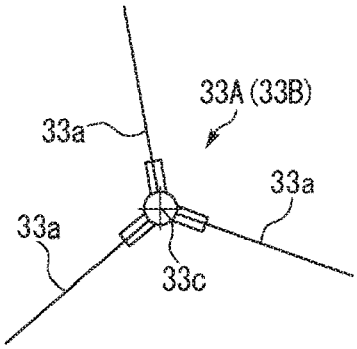

FIGS. 22A and 22B are schematic diagrams illustrating the first agitator 33A and the second agitator 33B according to a variation.

As illustrated in FIG. 22A, the flap 33*a* may be formed to extend from the rotation axis 33*c* in only one radial direction.

Alternatively, as illustrated in FIG. 22B, the flaps 33*a* may be formed to extend from the rotation axis 33*c* in three radial directions. Or, the flaps 33*a* may be formed to extend from the rotation axis 33*c* in four or more radial directions.

In configurations including the flaps 33*a* described above, substantially same effects as the present embodiment described below are also attained.

As described above, the toner container 30 serving as the powder container according to the present embodiment includes the flap 33*a* that rotates about the rotation axis 33*c* and has the comb-teeth tip portions 331 to 334 that contact and slide along the inner wall surface of the case 59 of the toner container 30 serving as the power container. The comb-teeth tip portions 331 to 334 of the flap 33*a* are formed such that the distance A from the root N between adjacent teeth to the rotation axis 33*c* when the comb-teeth tip portion does not contact the inner wall surface of the case 59 is longer than distances H1 and H2 that are the shortest distances between the rotation axes 33*c* and the inner wall surface of the case 59 in the first agitator 33A and the second agitator 33B, respectively.

This enables the flap 33*a* to sufficiently agitate toner in the toner container.

In the above-described embodiments, the present disclosure is applied to the process cartridge 10 as a single unit including the photoconductor drum 1 serving as an image bearer, the charging roller 4 serving as a charger, the developing device 5, the cleaner 2, and the waste toner conveyor 6. However, the present disclosure is not limited to the embodiments described above and may be applied to the image forming apparatus in which each of the above-described devices (i.e., the photoconductor drum 1, the charging roller 4, the developing device 5, the cleaner 2, and the waste toner conveyor 6) is removably installed as a single unit into the image forming apparatus 100.

In such configurations, similar effects to the embodiments described above are also attained.

It is to be noted that the term "process cartridge" used in the present disclosure means a removable device (a removable unit) including an image bearer and at least one of a charger to charge the image bearer, a developing device to develop latent images on the image bearer, and a cleaner to clean the image bearer that are united together, and is designed to be removably installed as a united part in the apparatus body of the image forming apparatus.

In the above-described embodiments, the present disclosure is applied to the toner container 30 serving as the powder container included in the image forming apparatus 100 that performs monochrome image formation. Alternatively, the present disclosure may be applied naturally to a toner container serving as a powder container included in a color image forming apparatus.

In the above-described embodiments, the present disclosure is applied to the toner container 30 serving as the powder container indirectly installed in and removed from the image forming apparatus 100 via the process cartridge 10. Alternatively, the present disclosure may be applied to a toner container serving as a powder container directly installed in and removed from the image forming apparatus 100 without going through the process cartridge 10.

In the above-described embodiments, the present disclosure is applied to the toner container 30 serving as the powder container to store toner that is the one-component developer and supply the toner to the developing device 5 for a one-component developing method. Alternatively, the present disclosure may be applied to a toner container serving as a powder container to supply toner to the developing device 5 for a two-component developing method.

In the above-described embodiments, the present disclosure is applied to the toner container 30 serving as the powder container in which toner as the one-component developer and powder is stored and collected. Alternatively, the present disclosure may be applied to a toner container serving as a powder container in which the two-component developer as powder is stored and collected. The two-component developer is a mixture of toner and carrier. In this case, a developing device employs the two-component developing method.

In the above-described embodiments, the present disclosure is applied to the toner container 30 serving as the powder container including the toner storage 31 and the waste toner collection portion 32 as a single unit. Alternatively, the present disclosure may be applied to a toner container serving as a powder container including only a toner storage serving as a powder storage.

Any of the cases described above exhibits similar effect to those of the above-described embodiments.

In the above-described embodiments, the present disclosure is applied to the toner storage 31 of the toner container 30 to supply toner as powder to the developing device 5, but a powder container to which the present disclosure is applied is not limited thereto. Alternatively, the present disclosure may be applied to a developing device to store toner as powder and develop a latent image formed on an image bearer to a toner image (for example, the developing device 5 in the above-described embodiments, a united device including a developing device and a toner container, and the like). Further, the present disclosure is applied to other powder containers (for example, the cleaner 2 or the waste toner collection portion 32) included in the image forming apparatus and yet other powder containers included in any device other than the image forming apparatus if powder is stored therein.

Any of the cases described above exhibits similar effect to those of the above-described embodiments.

In the above-described embodiments, the comb-teeth tip portions 331 to 334 includes two or three teeth, but the number of the teeth is not limited to these. The number of teeth in the comb-teeth tip portion of the flap 33*a* in FIG. 18 does not match the number of teeth in the comb-teeth tip portion of the flap 33*a* in FIG. 19, but the comb-teeth tip portion having any number of teeth can achieve the above-described effects of the present disclosure.

In the present embodiments, the first agitator 33A and the second agitator 33B includes the four comb-teeth tip portions 331 to 334, but the number of the comb-teeth tip portions is not limited to this and may be one to three, five or more.

In the present embodiments, the first agitator 33A and the second agitator 33B includes the two comb-teeth tip portions 331 and 332 in one radial direction and the two comb-teeth tip portions 333 and 334 in the other radial direction, but the number of the comb-teeth tip portions in each radial direction is not limited to this and may be one, three or more.

In the present embodiment, the distance B from the tooth tips M of the plurality of teeth in the first agitator 33A and the second agitator 33B to the rotation axis 33*c* is configured to gradually decrease or increase from one end to the other end, but the distance B from the tooth tips M of the plurality of teeth to the rotation axis 33*c* may be configured to increase and decrease in a discrete manner from one end to the other end.

In the present embodiment, although the tooth tips M of the comb-teeth tip portions 331 to 334 are formed to be substantially horizontal to the rotation axis direction, respectively, the tooth tip portions of the comb-teeth tip portions may be formed to be inclined with respect to the rotation axis direction.

In the present embodiment, the present disclosure is applied to the toner container serving as the powder container including the coil-shaped agitator 44, the first agitator 33A, and the second agitator 33B. In contrast, the present disclosure may be applied to the toner container not including the coil-shaped agitator or the toner container including one agitator or three or more agitators.

Any of the cases described above exhibits similar effect to those of the above-described embodiments.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above, and desirable numbers, positions, and shapes can be determined as required to practice the present disclosure.

Note that, in the present disclosure, the powder container is a device configured to mainly stir powder to be used in the image forming apparatus or stir the used powder in the image forming apparatus. Therefore, the powder container includes a device configured to stir fresh toner or fresh developer and a device configured to stir the used toner or used developer.

In the present disclosure, the width direction is perpendicular to a direction in which the toner container 30 serving as the powder container is attached to the process cartridge 10. The toner container 30 serving as the powder container has a longitudinal direction and a short side direction, and the width direction is the longitudinal direction of the toner container 30 serving as the powder container. In addition, the width direction is a direction in which a shaft of a rotator extends.

In the present disclosure, one end side in the width direction means one portion side when the toner container 30 is divided into two portions at the center of the toner container 30. In the present disclosure, the other end side in the width direction means the other portion side when the toner container 30 is divided into two portions at the center of the toner container 30.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A powder container, comprising:

an inner wall;

and a plurality of flaps configured to rotate about a rotation axis, each of the plurality of flaps including a comb-teeth tip portion configured to contact and slide along an inner wall surface of the powder container, the comb-teeth tip portion having teeth, the plurality of flaps extending from the rotation axis in a plurality of radial directions such that the plurality of flaps are in a zig-zag pattern about the rotational axis, and a distance from a root between adjacent teeth of a respective one of the plurality of flaps to the rotation axis when the comb-teeth tip portion does not contact the inner wall surface is longer than a shortest distance from the inner wall surface to the rotation axis.

2. The powder container according to claim 1, wherein distances in the comb-teeth tip portion from tooth tips of adjacent teeth to the rotation axis are different when the comb-teeth tip portion does not contact the inner wall surface.

3. The powder container according to claim 1, wherein the plurality of flaps includes a plurality of comb-teeth tip portions disposed at intervals in a direction of the rotation axis in each of the plurality of radial directions and alternately disposed in adjacent radial directions not to be located in a same range in the direction of the rotation axis such that the plurality of flaps are arranged in the zig-zag pattern.

4. The powder container according to claim 3, wherein distances from tooth tips in a plurality of teeth to the rotation axis are all different in each of the plurality of comb-teeth tip portions.

5. The powder container according to claim 4, further comprising:

a conveyer to convey powder stored in the powder container in a conveyance direction along the direction of the rotation axis, wherein distances from tooth tips in the plurality of teeth to the rotation axis gradually decrease from upstream to downstream in the conveyance direction in each of the plurality of comb-teeth tip portions.

6. The powder container according to claim 3, wherein an average of distances from tooth tips in a plurality of teeth of one comb-teeth tip portion in one radial direction to the rotation axis is different from another average of distances from tooth tips in a plurality of teeth of another comb-teeth tip portion in the one radial direction to the rotation axis.

7. The powder container according to claim 1, wherein the comb-teeth tip portion includes at least three or more teeth, and distances of the teeth from roots between adjacent teeth to the rotation axis are different when the comb-teeth tip portion does not contact the inner wall surface.

8. The powder container according to claim 1, wherein the powder container is configured to store toner as powder; and the powder container is one of a developing device configured to develop a latent image formed on an image bearer and a toner container configured to supply toner as powder to the developing device.

9. A process cartridge comprising:

the powder container according to claim 1, wherein the process cartridge is configured to be installable in and removable from an image forming apparatus.

10. An image forming apparatus comprising:

the powder container according to claim 1.

11. The powder container of claim 1, wherein the plurality of flap include at least a first pair of flaps and a second pair of flaps, the first pair of flaps extending from the rotation axis in first radial direction and the second a pair of flaps extending from the rotational axis in a second radial direction, the second pair of flaps offset from the first pair of flaps in a direction of the rotational axis such that the plurality of flaps are in the zig-zag pattern.

12. The powder container of claim 1, wherein the plurality of flap include at least a first pair of flaps and a second pair of flaps such that the teeth associated with the comb-teeth tip portion of one of the first pair of flaps and the teeth associated with the comb-teeth tip portion of one of the second pair of flaps are configured to contact different portions of the inner wall surface.

13. The powder container of claim 1, wherein the respective one of the plurality of flaps has at least three teeth.

14. The powder container of claim 1, wherein the teeth of the respective one of the plurality of flaps have different sizes.

* * * * *